US005524792A

United States Patent [19]

Wakabayashi et al.

[11] Patent Number: 5,524,792

[45] Date of Patent: Jun. 11, 1996

[54] CUP VENDOR DELIVERY NOZZLE

[75] Inventors: Asami Wakabayashi; Katsuyuki Uchida; Tomoaki Tadokoro; Takayo Katsuki, all of Nagaokakyo, Japan

[73] Assignee: Murata Manufacturing Co., Ltd., Japan

[21] Appl. No.: 413,918

[22] Filed: Mar. 30, 1995

Related U.S. Application Data

[63] Continuation of Ser. No. 88,441, Jul. 7, 1993, abandoned.

[30] Foreign Application Priority Data

| | | | |
|---|---|---|---|
| Jul. 8, 1992 | [JP] | Japan | 4-181321 |
| Jul. 28, 1992 | [JP] | Japan | 4-201324 |
| Jul. 28, 1992 | [JP] | Japan | 4-201325 |
| Sep. 4, 1992 | [JP] | Japan | 4-237007 |
| Sep. 4, 1992 | [JP] | Japan | 4-237008 |
| May 7, 1993 | [JP] | Japan | 5-106667 |
| May 7, 1993 | [JP] | Japan | 5-106668 |
| May 7, 1993 | [JP] | Japan | 5-106669 |
| May 7, 1993 | [JP] | Japan | 5-106670 |

[51] Int. Cl.[6] ..... B67D 5/62

[52] U.S. Cl. ..... 222/146.5; 222/129.1; 392/473

[58] Field of Search ..... 222/129.1, 129.2, 222/129.3, 129.4, 146.2, 146.5; 239/135, 136; 219/205; 392/473, 474, 475, 476

[56] References Cited

U.S. PATENT DOCUMENTS

| | | | |
|---|---|---|---|
| 3,144,174 | 8/1964 | Abplanalp | 222/146.2 |
| 4,088,269 | 5/1978 | Schlick | 222/146.5 X |
| 4,506,138 | 3/1985 | Bennett et al. | 219/205 |
| 4,580,037 | 4/1986 | Muller | 222/146.5 X |
| 4,904,155 | 2/1990 | Nagaoka et al. | 222/146.5 X |

FOREIGN PATENT DOCUMENTS

| | | | |
|---|---|---|---|
| 2758157 | 6/1979 | Germany | 219/205 |
| 3046471 | 6/1982 | Germany | 222/146.5 |
| 0193625 | 10/1985 | Japan | 222/146.5 |

*Primary Examiner*—Joseph A. Kaufman
*Attorney, Agent, or Firm*—Ostrolenk, Faber, Gerb & Soffen

[57] ABSTRACT

Disclosed herein is a cup vendor delivery nozzle comprising a nozzle body of resin etc. having a substantially cylindrical shape, a PTC element for heating an inner surface of the nozzle body, and a metal body for transferring heat from the PTC element to the interior of the nozzle body.

20 Claims, 23 Drawing Sheets

CUP VENDOR DELIVERY NOZZLE

This is a continuation of application Ser. No. 08/088,441 filed on Jul. 7, 1993 now abandoned.

BACKGROUND OF THE INVENTION

1. Field of the Invention

The present invention relates to a delivery nozzle for a cup vendor for supplying cola, juice or the like to a cup of paper or the like.

2. Description of the Background Art

In a cup vendor for supplying cola, juice or the like, syrup and soda water or water are independently supplied from a delivery port which is provided in the body of the cup vendor, and stirred in a delivery nozzle which is mounted on the delivery port, to be supplied into a cup as a mixed liquid from the nozzle. FIG. 38 is a side elevational view showing a conventional delivery nozzle 1 for such a cup vendor and a delivery port 2 provided on the body of the cup vendor. Referring to FIG. 38, the delivery nozzle 1 has an entry 1*a* provided on its upper portion, a nozzle inner surface, which is slightly smaller in diameter than the entry 1*a*, provided on its lower portion, and a mixed liquid delivery port 1*b* provided on a lower end of the nozzle inner surface. FIG. 39 is a perspective view showing such a delivery nozzle 1.

The body delivery port 2 of the cup vendor is provided on its center with a downwardly projecting syrup supply port 2*a*. A downwardly opening supply port 2*b* for soda water or water is provided in a seating portion around the syrup supply port 2*a* in an outwardly inclined manner. A rubber packing 3 is engaged with the outer periphery of the body delivery port 2, to come into pressure contact with the inner surface of the entry 1*a* when the body delivery port 2 is inserted in the entry 1*a* of the delivery nozzle 1.

The soda water or water which is supplied from the supply port 2*b* to the inner surface of the delivery nozzle 1 downwardly comes into contact with the nozzle inner surface and is mixed with the syrup which is supplied from the syrup supply port 2*a*, to be downwardly supplied as a mixed liquid to a cup from the mixed liquid delivery port 1*b*.

After the mixed liquid is downwardly supplied to the cup in such a delivery port of the cup vendor, however, a remainder containing the syrup is disadvantageously left in the nozzle. When such a remainder of the mixed liquid is kept intact, sugar contained therein causes invasion of injurious insects such as ants or cockroaches, or bacterial multiplication. In order to prevent such invasion of injurious insects and bacterial multiplication, therefore, it is necessary to detach the nozzle from the cup vendor and wash the same during the nighttime when the cup vendor is not used. However, it is extremely troublesome to wash the nozzle as a daily activity.

SUMMARY OF THE INVENTION

An object of the present invention is to provide a cup vendor delivery nozzle which can prevent invasion of injurious insects and bacterial multiplication with no requirement for washing.

The feature of the cup vendor delivery nozzle according to the present invention resides in that a heater is provided for heating a nozzle inner surface.

This heater is preferably formed by a positive temperature coefficient (PTC) thermistor element. Such a PTC thermistor element has high safety due to its self temperature control function, and can efficiently heat the nozzle inner surface without excessive heating beyond that necessary.

The inventive cup vendor delivery nozzle thus comprises a heater for heating the nozzle inner surface, whereby a remainder of a liquid containing sugar which is left in the nozzle is heated and dried by the heater. Thus, it is possible to prevent bacterial multiplication by removing moisture through such drying. Since the nozzle inner surface is heated by the heater, it is possible to prevent invasion of injurious insects such as ants or cockroaches.

According to a first aspect of the present invention, the cup vendor delivery nozzle comprises a nozzle body having a substantially cylindrical shape, and a heater for heating the inner surface of the nozzle body.

According to a second aspect of the present invention, the cup vendor delivery nozzle comprises a nozzle body having a substantially cylindrical shape, a heater for heating the inner surface of the nozzle body, and a metal body for transferring heat from the heater to the interior of the nozzle body.

According to a third aspect of the present invention, the nozzle body is divided into an outer nozzle body and an inner nozzle body, while the metal body is provided between the outer and inner nozzle bodies.

According to a fourth aspect of the present invention, the metal body is integrally provided in the interior of the nozzle body by insert molding.

According to a fifth aspect of the present invention, the metal body has a terminal part which serves as at least one terminal of the heater.

According to a sixth aspect of the present invention, the cup vendor delivery nozzle further comprises heater pressing means which allows the heater to come into pressure contact with and separate from the metal body.

According to a seventh aspect of the present invention, the heater has at least two branched forward end portions for detachably holding the nozzle body therebetween, and at least one heating portion which is provided in the inner surface of either branched forward end portion to be in contact with the metal body.

According to an eighth aspect of the present invention, the cup vendor delivery nozzle further comprises a resin coating for covering the periphery of the heater in order to protect the heater against water.

According to a ninth aspect of the present invention, the cup vendor delivery nozzle further comprises a magnet which is provided on one of the nozzle body and the heater, and a ferromagnetic material member which is provided on the other one of the nozzle body and the heater.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
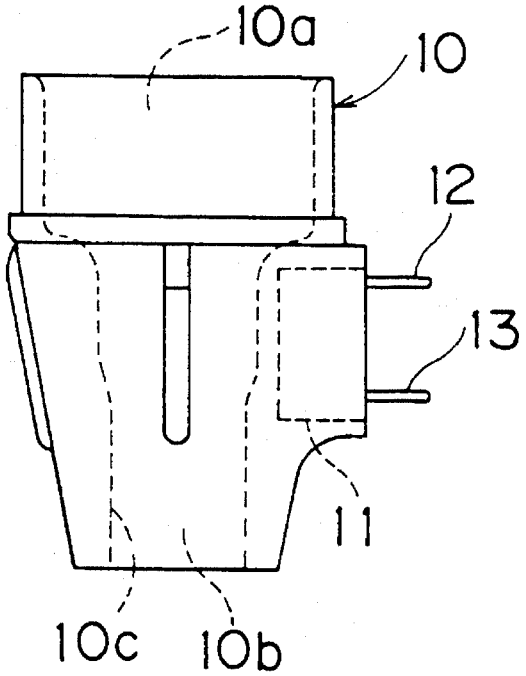
FIG. 1 is a side elevational view showing a delivery nozzle of an embodiment according to the first aspect of the present invention.
Figure 2:
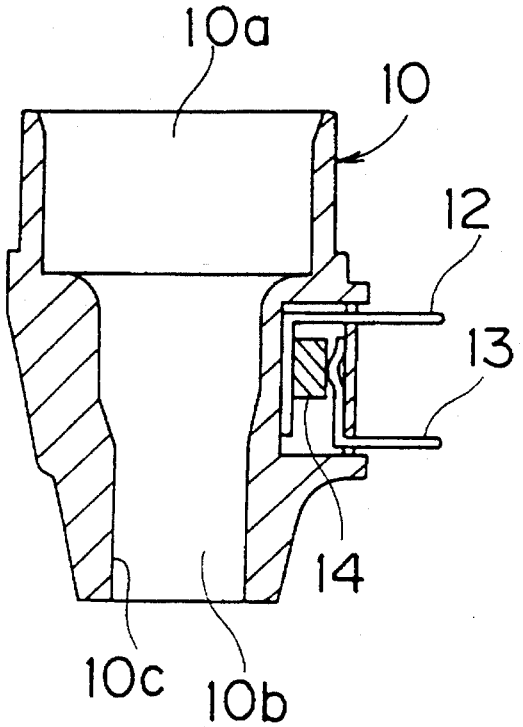
FIG. 2 is a longitudinal sectional view of the embodiment shown in FIG. 1.

FIG. 1 is a side elevational view showing a delivery nozzle 10 of an embodiment (Example 1—1) according to the first aspect of the present invention, and FIG. 2 is a sectional view showing this embodiment (Example 1—1). Referring to FIGS. 1 and 2, the delivery nozzle 10 is provided in its upper portion with an entry 10*a* to be inserted in a body delivery port. A nozzle surface 10*a* having a slightly narrowed diameter is provided under the entry 10*a*. Soda water or water which is supplied from the body delivery port comes into contact with the nozzle surface 10*c* and is mixed with syrup, to downwardly fall as a mixed liquid. A mixed liquid delivery port 10*b* is provided on a lower portion of the delivery nozzle 10.

According to this embodiment (Example 1—1), a heater 11 is embedded in a side wall of the delivery nozzle 10 to heat the nozzle surface 10*c*. As shown in FIG. 2, this heater 11 is formed by holding a PTC element 14 by a flat terminal 12 and a spring terminal 13. A voltage is applied across the flat terminal 12 and the spring terminal 13, so that the PTC element 14 generates heat for heating the nozzle surface 10*c*.

In Example 1—1, the PTC element 14 was prepared from that having a resistance value of 30 Ω and a resistance/temperature characteristic Cp of 80° C., and a dc voltage of 12 V was applied across the terminals 12 and 13.

The temperature at a central portion of the delivery nozzle 10 reached 45° C. after about one hour. A mixed liquid containing syrup was supplied through this delivery nozzle 10. After this supply, no remainder of the mixed liquid was left in the delivery nozzle 10, with complete removal of moisture.

According to the inventive cup vendor delivery nozzle, as hereinabove described, it is possible to completely remove moisture from the nozzle, thereby preventing bacterial multiplication or the like.

Further, it is also possible to prevent invasion of injurious insects such as ants or cockroaches by heating the interior of the nozzle.

Figure 3:
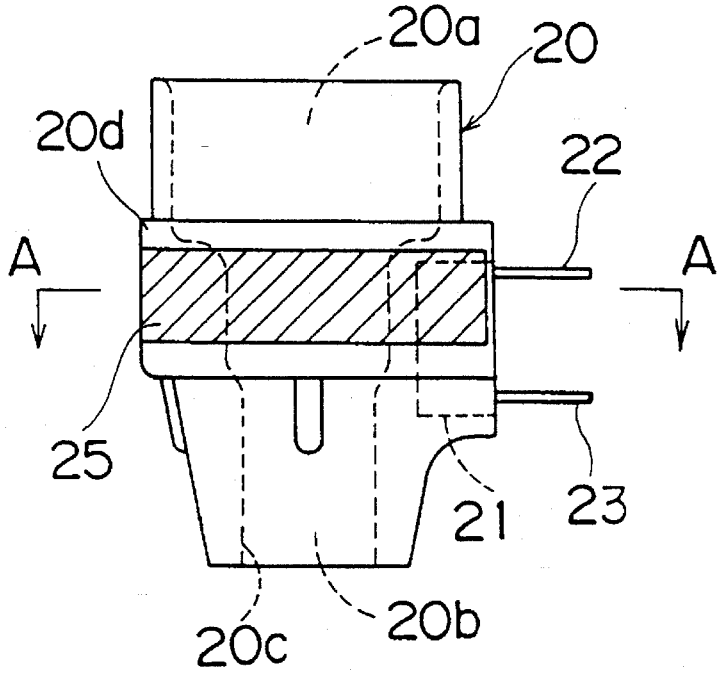
FIG. 3 is a side elevational view showing a delivery nozzle of an embodiment according to the second aspect of the present invention.
Figure 4:
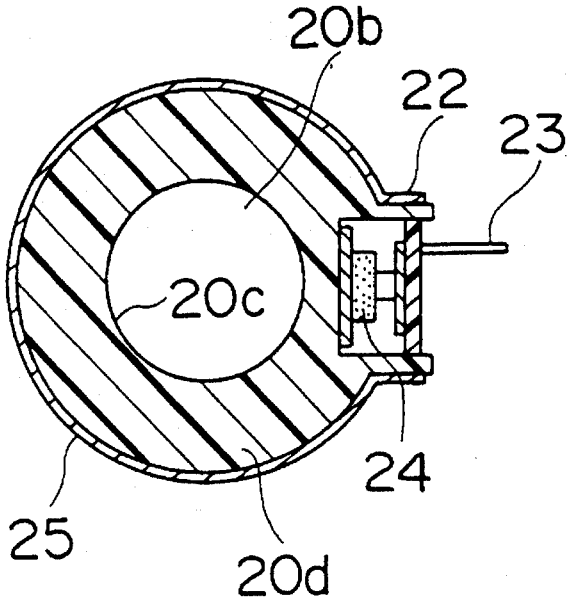
FIG. 4 is a cross-sectional view taken along the line A—A in FIG. 3.

FIG. 3 is a side elevational view showing an embodiment (Example 2-1) according to the second aspect of the present invention, and FIG. 3 is a sectional view taken along the line A—A in FIG. 3. Referring to FIGS. 3 and 4, a delivery nozzle 20 is provided on its upper portion with an entry 20*a* to be inserted in a body delivery port. A portion located under the entry is slightly narrowed in diameter, and provided with a nozzle surface 20*c*. Soda water or water which is supplied from the body delivery port comes into contact with the nozzle surface 20*c* and is mixed with syrup, to downwardly fall as a mixed liquid. A mixed liquid delivery port 20*b* is provided on a lower portion of the delivery nozzle 20.

According to this embodiment, a heater 21 is embedded in a wall portion of the delivery nozzle 20, in order to heat the nozzle surface 20*c*. As shown in FIG. 4, this heater 21 is formed by holding a PTC element 24 by a flat terminal 22 and a spring terminal 23. On the other hand, a metal hoop 25 is mounted on the outer peripheral surface of a nozzle body 20*d* of the delivery nozzle 20. According to this embodiment, the metal hoop 25 is prepared from aluminum. A voltage is applied across the flat terminal 22 and the spring terminal 23 so that the PTC element generates heat, which in turn is transferred to the overall nozzle body 20*d* through the metal hoop 25 to heat the nozzle surface 20*c*.

Figure 5:
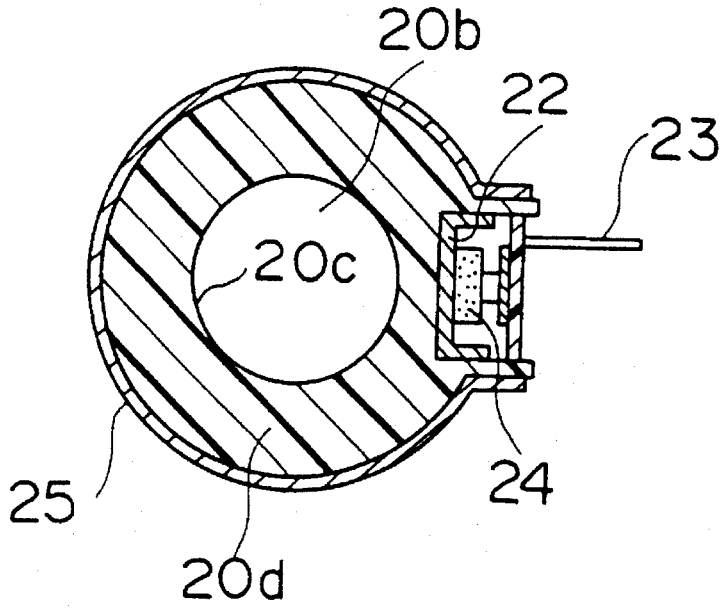
FIG. 5 is a cross-sectional view showing another embodiment according to the second aspect of the present invention.

FIG. 5 is a sectional view, corresponding to FIG. 4, showing another embodiment (Example 2—2) according to the second aspect of the present invention. According to this embodiment, both ends of a flat terminal 22 are further extended along a side wall portion of a hole provided with a PTC element 24, in order to facilitate transfer of heat from the flat terminal 22 to a metal hoop 25.

Figure 6:
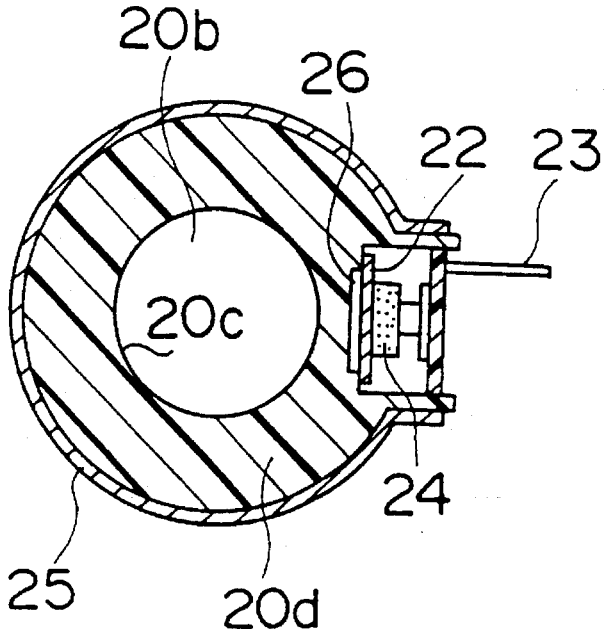
FIG. 6 is a cross-sectional view showing still another embodiment according to the second aspect of the present invention.

FIG. 6 is a sectional view, corresponding to FIG. 4, showing a delivery nozzle of still another embodiment (Example 2-3) according to the second aspect of the present invention. According to this embodiment, a clearance 26 is defined in a portion of a nozzle body 20*d* which is in contact with a flat terminal 22. Due to such a clearance 26, it is possible to prevent the portion of the nozzle body 20*d*, which is in contact with the flat terminal 22, from excessive heating for preventing extreme temperature rise in a nozzle inner surface 20*c* close to a PTC element 24, thereby improving temperature homogeneity along the overall delivery nozzle.

In Examples 2-1, 2—2 and 2-3 shown in FIGS. 4 to 6, the PTC elements 24 were prepared from those having diameters of 6 mm, thicknesses of 1.5 mm, Curie points of 80° C. and $R_{25}$ of 30 Ω. On the other hand, the metal hoops 25 were prepared from those of aluminum having widths 8 mm and thicknesses of 0.5 mm.

In Example 2—2 shown in FIG. 5, both ends of the flat terminal 22 along the side wall portion were 4 mm in length.

In Example 2-3 shown in FIG. 6, on the other hand, the clearance 26 was defined in a circular shape with a diameter of 8 mm and a depth of 0.5 mm. The PTC element 24 was arranged at a substantially central portion of the clearance 26 through the flat terminal 22.

In Examples 2-1, 2—2 and 2-3, dc currents of 12 V were fed for 60 minutes, to thereafter measure temperatures at heater side portions and opposite portions of the nozzle bodies 20*d*.

For the purpose of comparison, the delivery nozzle shown in FIGS. 1 and 2, provided with no metal hoop, was energized similarly to the above, to thereafter measure temperatures at a heater side portion and an opposite side portion. Table 1 shows the results.

TABLE 1

| | Temperature on Heater Side | Temperature on Opposite Side |
|---|---|---|
| Example 2-1 | 68.1° C. | 35.2° C. |
| Example 2-2 | 66.5° C. | 40.0° C. |
| Example 2-3 | 60.1° C. | 38.0° C. |
| Example 1-1 | 70.5° C. | 27.0° C. |

(Ambient Temperature: 25° C.)

As clearly understood from Table 1, the delivery nozzles according to Examples 2-1 to 2-3 exhibited smaller temperature differences between the heater sides and the opposite sides as compared with the delivery nozzle provided with no metal hoop. Thus, it has been confirmed possible to improve temperature homogeneity by providing the metal hoop.

Figure 7:
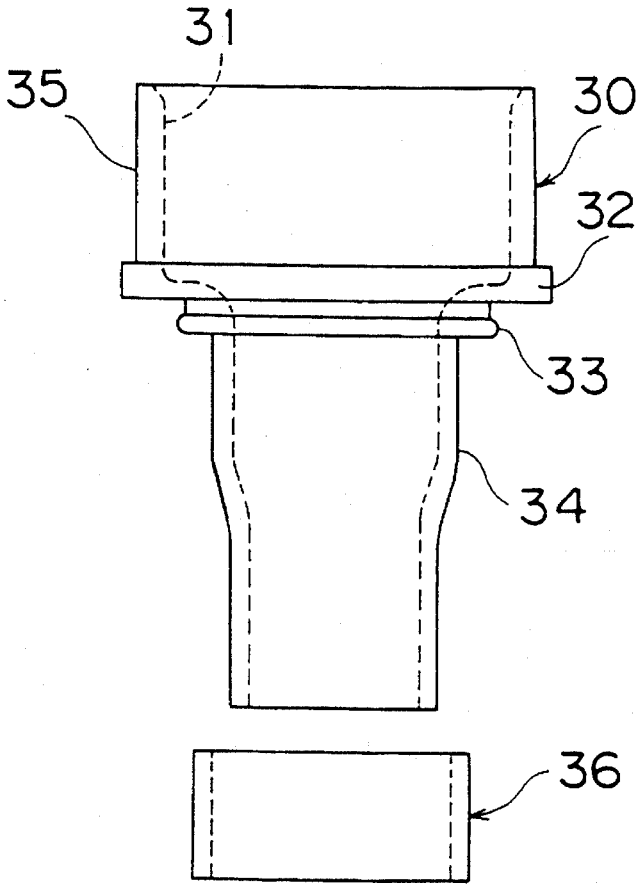
FIG. 7 is a side elevational view showing a delivery nozzle of an embodiment according to the third aspect of the present invention.
Figure 7:
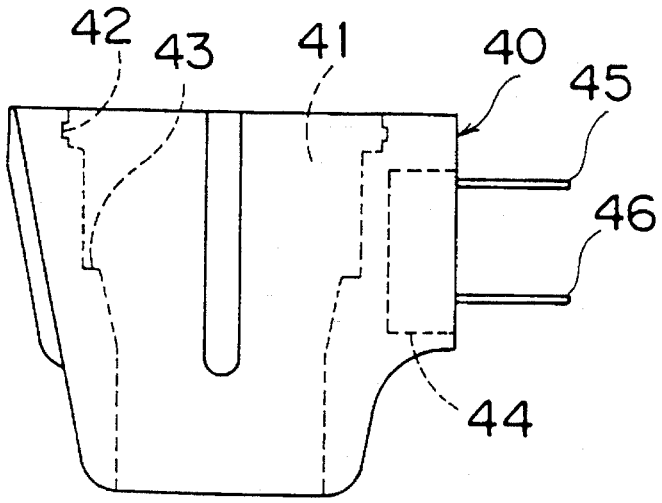

FIG. 7 is a side elevational view showing a delivery nozzle of an embodiment according to the third aspect of the present invention. Referring to FIG. 7, this delivery nozzle is formed by an inner nozzle body 30, a metal hoop 36, and an outer nozzle body 40.

The inner nozzle body 30 is provided with a through hole, the interior of which defines a nozzle inner surface 31. This inner nozzle body 30 is provided on its upper portion with an entry portion 35, which is inserted in a cup vendor body. A flange portion 32 is formed under this entry portion 35. An annular protrusion 33 is provided under the flange portion 32 to project toward the circumferential direction. A cylindrical insert portion 34 is provided under the protrusion 33. This cylindrical insert portion 34 is inserted inwardly in a cylindrical metal hoop 36 when the delivery nozzle is assembled.

A heater portion 44 is embedded in a side wall portion of the outer nozzle body 40, and terminals 45 and 46 are electrically connected to electrodes of this heater portion 44. A through hole 41 is formed in the interior of the outer nozzle body 40. An annular groove portion 42 is formed in an upper portion of the through hole 41, so that the protrusion 33 of the inner nozzle body 30 engages in this groove portion 42 when the inner and outer nozzle bodies 30 and 40 are assembled with each other. The through hole 41 is provided in its central portion, which is located under the groove portion 42, with a step portion 43. This step portion 43 comes into contact with a lower end of the as-inserted metal hoop 36, to support the same.

When the outer nozzle body 40, the metal hoop 36 and the inner nozzle body 30 are assembled with each other, the insert portion 34 of the inner nozzle body 30 is inserted in the cylindrical inner surface of the metal hoop 36. The flange portion 32 of the inner nozzle body 30 comes into contact with an upper end of the outer nozzle body 40 and the protrusion 33 of the inner nozzle body 30 engages in the groove portion 42 of the outer nozzle body 40, to maintain the assembled state. As hereinabove described, the lower end of the metal hoop 36 comes into contact with the step portion 43 provided on the through hole 41 of the outer nozzle body 40, to be supported by the same. In such an assembled state, the lower end of the nozzle inner surface 31 of the inner nozzle body 30 is positioned downwardly beyond the outer nozzle body 40. Therefore, it is possible to mount the delivery nozzle assembled in such a manner on the cup vendor body by inserting the entry portion 35 of the inner nozzle body 30 in the delivery port of the cup vendor body. A liquid which is supplied from the delivery port of the cup vendor body downwardly falls along the nozzle inner surface 31 of the inner nozzle body 30, to be supplied in a cup.

Figure 8:
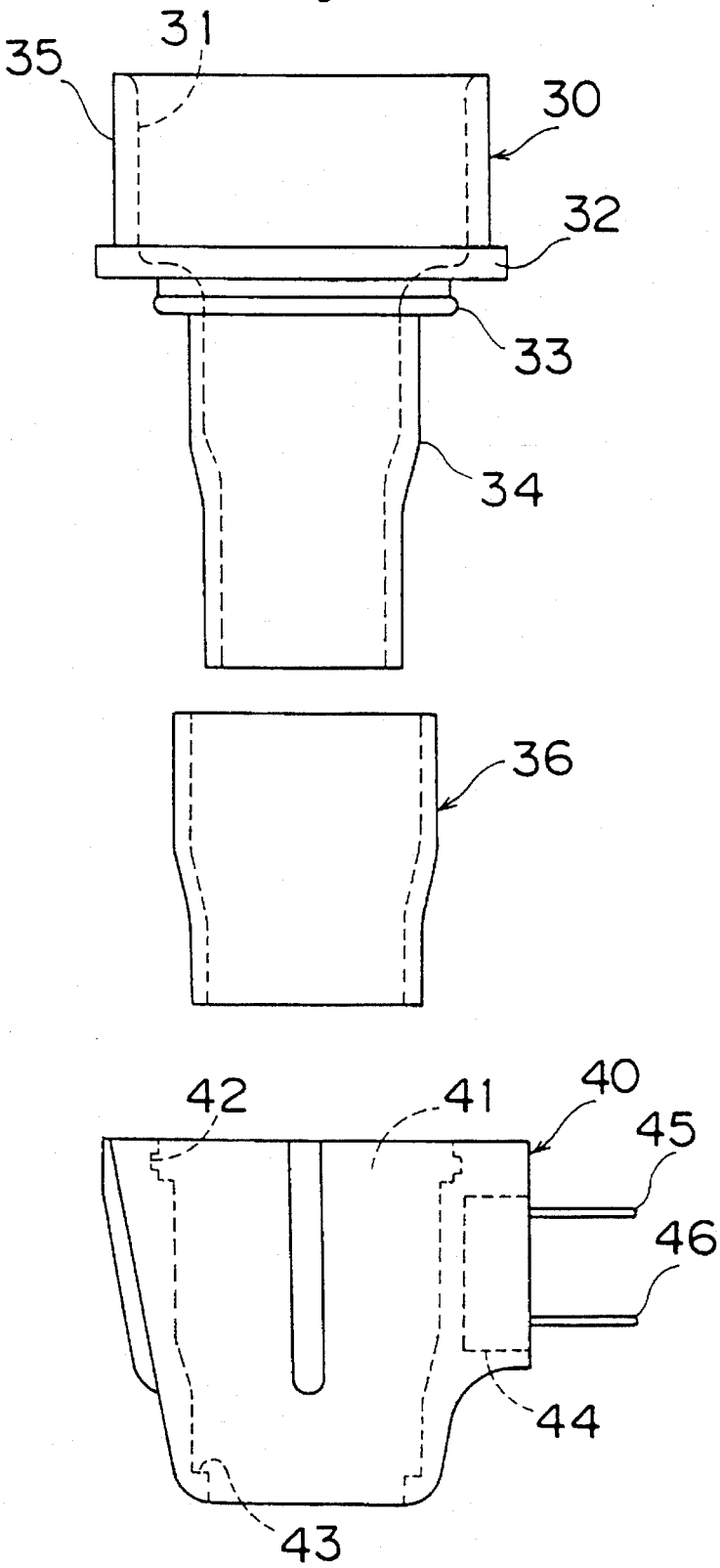
FIG. 8 is a side elevational view showing a delivery nozzle of another embodiment according to the third aspect of the present invention.

FIG. 8 is a side elevational view showing a delivery nozzle of another embodiment according to the third aspect of the present invention. According to this embodiment, a downwardly elongated metal hoop 38 is so employed that it is possible to further homogeneously heat a nozzle surface also at the forward end of the delivery nozzle. Due to such a downwardly elongated metal hoop 36 employed in this embodiment, a step portion 43 which is formed in a through hole 41 of an outer nozzle body 40 is provided in a portion lower than that of the embodiment shown in FIG. 7. This embodiment is similar in other structure to that shown in FIG. 7, and hence corresponding elements are shown by the same reference numerals, to omit redundant description.

Figure 9:
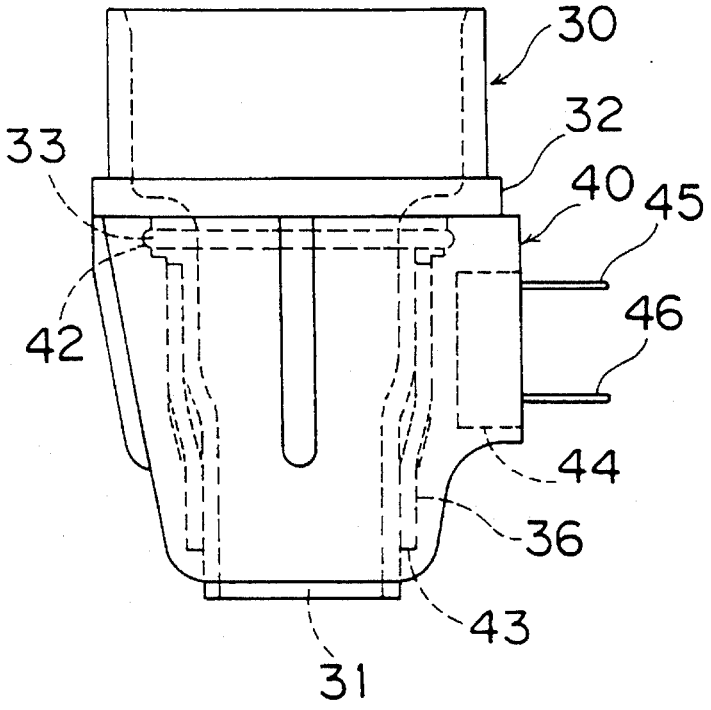
FIG. 9 is a side elevational view showing an assembled state of the embodiment shown in FIG. 8.
Figure 10:
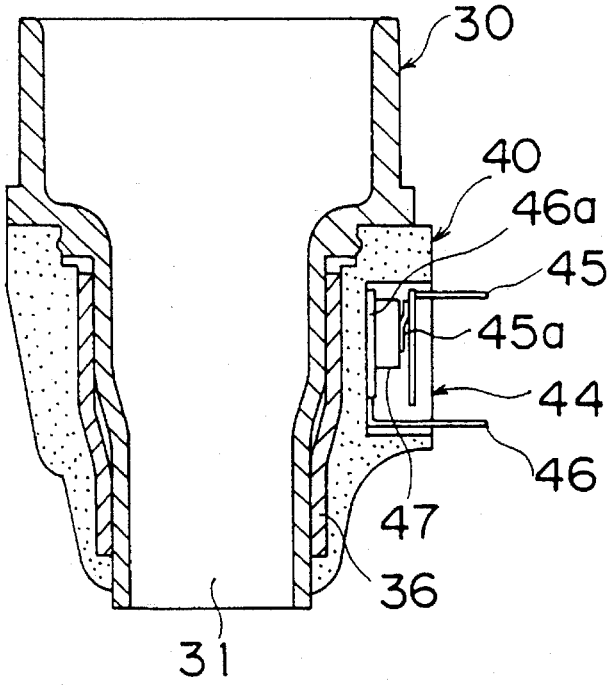
FIG. 10 is a longitudinal sectional view showing the delivery nozzle in the assembled state appearing in FIG. 9.

FIG. 9 is a side elevational view showing an assembled state of the embodiment shown in FIG. 8, and FIG. 10 is a longitudinal sectional view showing the assembled state. Referring to FIGS. 9 and 10, a lower end of a flange portion 32 of an inner nozzle body 30 is in contact with an upper end of the outer nozzle body 40. Further, a protrusion 33 of the inner nozzle body 30 engages in a groove portion 42 of the outer nozzle body 40. The assembled state of the inner nozzle body 30, the metal hoop 36 and the outer nozzle body 40 is maintained by such engagement. Further, a lower end of the metal hoop 38 is in contact with the step portion 43 provided in the through hole 41 of the outer nozzle body 40. In such an assembled state, the lower end of the inner nozzle body 30 downwardly projects beyond the outer nozzle body Referring to FIG. 10, a heater portion 44 is formed by a PTC element 47 and terminals 45 and 46. The terminal 45 is formed by a spring terminal having a spring portion **45*a*, while the terminal 46 is formed by a flat plate terminal having a flat plate portion 46*a*. The spring portion 45*a* and the flat plate portion 46*a* are in contact with electrodes of the PTC element 47. A voltage is applied across these terminals 45 and 46 so that the PTC element 47 generates heat, which in turn is transferred to the metal hoop 36. Since the metal hoop 36 is made of a metal having excellent thermal conductivity, the heat is transferred through the metal hoop 36 to homogeneously heat the inner nozzle body 30**.

In a sample (hereinafter referred to as "Example 3-1") of the embodiment shown in FIG. 7, the inner and outer nozzle bodies 30 and 40 were prepared from ABS resin, the metal hoop 36 was prepared from AIP with a thickness of 0.5 mm and a width of 7 mm, and the heater portion 44 was prepared from a PTC element having a diameter of 6.0 mm, a thickness of 1.5 mm and a Curie point (Cp) of 60°60 C., to prepare a delivery nozzle.

In a sample (hereinafter referred to as "Example 3-2") of the embodiment shown in FIG. 8, the inner and outer nozzle bodies 30 and 40 were prepared similarly from ABB resin and the metal hoop 36 was prepared in a similar manner to Example 3-1 except that its width was 16 mm, while a PTC element similar to that in Example 3-1 was employed, to prepare a delivery nozzle.

For the purpose of comparison, a sample of the delivery nozzle according to Example 2—2 shown in FIGS. 3 and 5 was employed.

Dc currents of 12 V were fed to the PTC elements of the delivery nozzles according to Examples 3-1, 3-2 and 2—2 for 30 minutes under environment at an ambient temperature of 25° C., to thereafter measure temperatures of respective portions. Table 2 shows the results.

TABLE 2

| | Temperature on Heater Side | Temperature on Opposite Side | Temperature at Forward End of Nozzle |
|---|---|---|---|
| Example 3-1 | 55.0° C. | 54.2° C. | 32.1° C. |
| Example 3-2 | 53.1° C. | 52.6° C. | 40.3° C. |
| Example 2-2 | 66.5° C. | 40.0° C. | 30.0° C. |

(Ambient Temperature: 25° C.

As clearly understood from Table 2, the delivery nozzles according to Examples 3-1 and 3-2 exhibited extremely small temperature differences between heater sides and opposite sides as compared with Example 2—2. Further, it is understood that the temperature at the forward end of the nozzle was also increased in the delivery nozzle according to Example 5-2, to attain excellent homogeneity also in the vertical direction.

According to the third aspect of the present invention, as hereinabove described, it is possible to evaporate moisture of the liquid adhering to the interior of the nozzle thereby preventing bacterial multiplication or the like, while such heating can be further homogeneously carried out along the overall nozzle body.

Further, it is possible to easily wash the delivery nozzle since the inner nozzle body having the nozzle inner surface is detachable.

Figure 11:
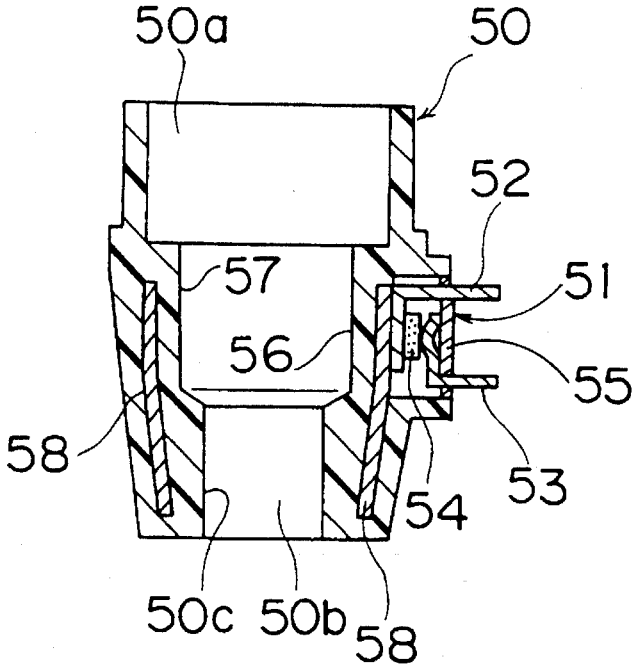
FIG. 11 is a longitudinal sectional view showing a delivery nozzle of an embodiment according to the fourth aspect of the present invention.
Figure 12:
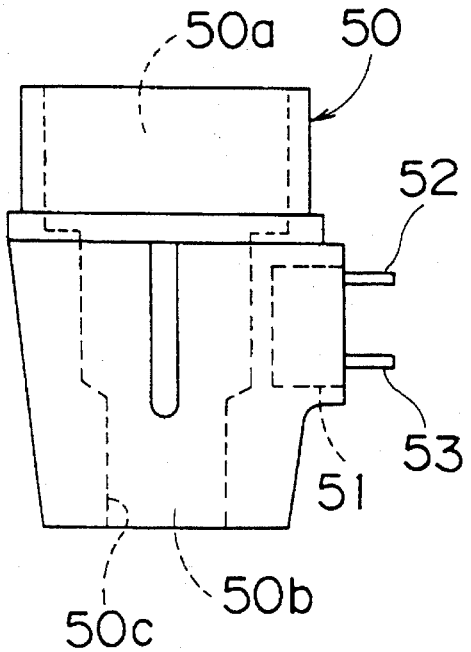
FIG. 12 is a side elevational view of the embodiment shown in FIG. 11.

FIG. 11 is a sectional view showing a delivery nozzle of an embodiment (Example 4-1) according to the fourth aspect of the present invention, and FIG. 12 is a side elevational view thereof. Referring to FIGS. 11 and 12, a nozzle body 50 of this delivery nozzle is provided on its upper portion with an entry **50*a* to be inserted in a body delivery port. A portion under the entry 50*a* is slightly narrowed in diameter, and provided with a nozzle surface 50*c*. Soda water or water which is supplied from the body delivery port comes into contact with the nozzle surface 50*c* and is mixed with syrup or the like, to downwardly fall as a mixed liquid. A mixed liquid delivery port 50*b* is provided on a lower portion of the nozzle body 50**.

Figure 13:
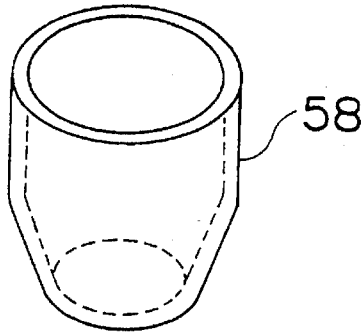
FIG. 13 is a perspective view showing a metal body employed in the embodiment shown in FIG. 11.

According to this embodiment, a heater 51 is stored in a wall portion of the nozzle body 50, in order to heat the nozzle surface **50*c*. As shown in FIG. 11, the heater 51 is formed by holding a PTC element 54 by a flat terminal 52 and a spring terminal 53, and mounting a cover 55 thereon. Further, a cylindrical metal heat transfer plate 58 is embedded in a wall portion of the nozzle body 50. This metal heat transfer plate is embedded in the wall portion by insert molding in formation of the nozzle body 50, to be integrated with the same. FIG. 13 is a perspective view showing the metal heat transfer plate 58. The metal heat transfer plate 58 shown in FIG. 13** is formed to have a substantially constant thickness as a whole.

As shown in FIG. 11, the metal heat transfer plate exposed in the portion provided with the heater 51, so that the flat terminal 52 of the heater 51 is partially in contact with the metal heat transfer plate 58 in this portion. According to this embodiment, the metal heat transfer plate 58 is made of aluminum.

A voltage is applied across the flat terminal 52 and the spring terminal 53 so that the PTC element 54 generates heat, which in turn is transferred to the overall nozzle body through the metal heat transfer plate 58, to heat the nozzle surface **50*c***.

Figure 14:
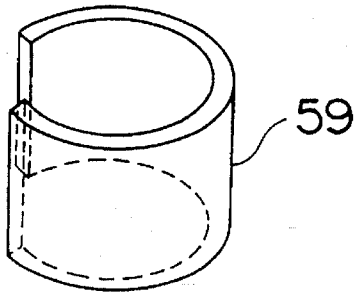
FIG. 14 is a perspective view showing a metal body employed in another embodiment according to the fourth aspect of the present invention.

FIG. 14 is a perspective view showing a metal heat transfer plate which is employed in another embodiment (Example 4-2) according to the fourth aspect of the present invention. The metal heat transfer plate employed in this aspect of the present invention is not restricted to the annular one shown in FIG. 13, but may be in any unrestricted shape so far as the same can transfer heat from the heater to the overall nozzle body. For example, the heat transfer plate may have a C-shaped section, as shown in FIG. 14.

Figure 15:
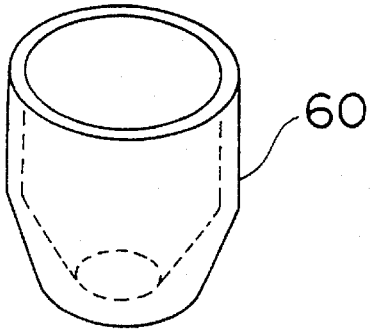
FIG. 15 is a perspective view showing a metal body employed in still another embodiment according to the fourth aspect of the present invention.

FIG. 15 is a perspective view showing a metal heat transfer plate 60 which is employed in still another embodiment (Example 4-3) according to the fourth aspect of the present invention. According to this embodiment, the metal heat transfer plate 80 is so formed that its thickness is increased in a lower portion corresponding to the mixed liquid delivery port 50*b* (shown in FIGS. 11 and 12) of the nozzle body, as shown in FIG. 15.

The heater of the nozzle body according to Example 4-2 employing the metal heat transfer plate 59 shown in FIG. 14 was heated, to measure temperatures at a temperature measuring point 58 on the heater 51 side and an opposite temperature measuring point 57 shown in FIG. 11. The PTC element 54 was prepared from that having a diameter of 6 mm, a Curie point of 80° C., and $R_{25}$ of 30 Ω. The metal heat transfer plate 59 was prepared from an aluminum metal plate, which was worked into a C shape with a diameter of 8 mm and a thickness of 0.5 mm.

A dc current of 12 V was fed to the heater 51 for 60 minutes, to thereafter measure temperatures at the temperature measuring points 56 and 57.

For the purpose of comparison, a similar current was also fed to the delivery nozzle according to Example 1—1 shown in FIGS. 1 and 2, provided with no metal heat transfer plate, to measure temperatures with heat generation of the PTC element. Table 3 shows the results.

TABLE 3

| | Temperature on Heater Side | Temperature on Opposite Side |
|---|---|---|
| Example 4-2 | 56.2° C. | 55.4° C. |
| Example 1-1 | 70.5° C. | 27.0° C. |

(Ambient Temperature: 25° C.)

It is clearly understood from Table 3 that the nozzle body of Example 4-2 according to the fourth aspect of the present invention exhibited an extremely small temperature difference between the heater side and the opposite side as compared with Example 1—1. Thus, it is understood possible to improve temperature homogeneity by providing the metal heat transfer plate in the nozzle body according to the fourth aspect of the present invention.

According to the fourth aspect of the present invention, as hereinabove described, it is possible to evaporate moisture adhering to the nozzle inner surface for preventing bacterial multiplication or the like, while such heating can be homogeneously carried out along the overall nozzle body.

Figure 16:
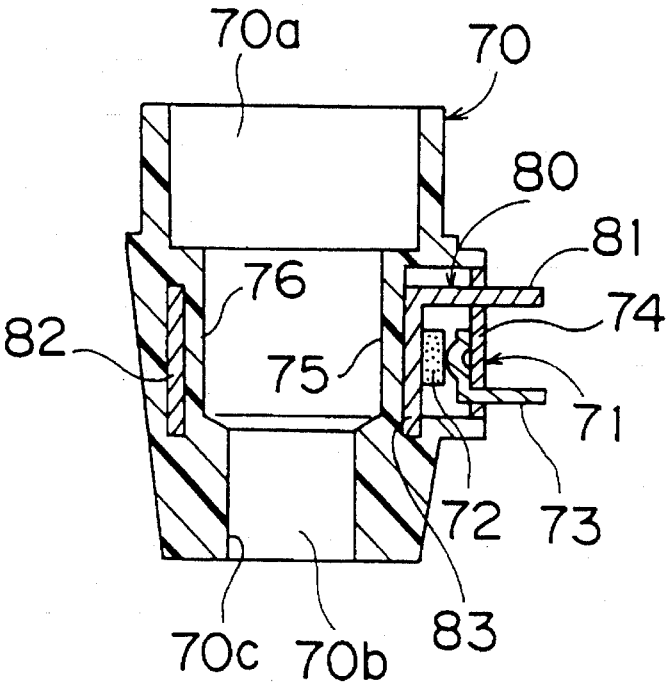
FIG. 16 is a longitudinal sectional view showing a delivery nozzle body of an embodiment according to the fifth aspect of the present invention.

FIG. 16 is a longitudinal sectional view showing a delivery nozzle body 70 of an embodiment (Example 5-1) according to the fifth aspect of the present invention. Referring to FIG. 16, the nozzle body 70 is provided on its upper portion with an entry 70*a* to be inserted in a body delivery port. A portion under the entry 70*a* is slightly narrowed in diameter, and is provided with a nozzle surface 70*c*. Soda water or water which is supplied from the body delivery port comes into contact with the nozzle surface 70*c*, and is mixed with syrup or the like to downwardly fall as a mixed liquid. A mixed liquid delivery port 70*b* is provided on a lower portion of the nozzle body 70.

Figure 17:
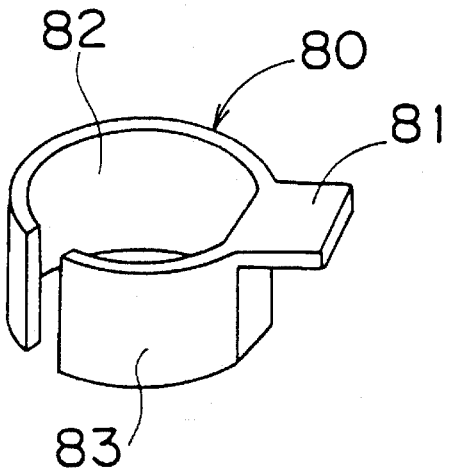
FIG. 17 is a perspective view showing a metal body employed in the embodiment shown in FIG. 16.

The nozzle body 70 is made of resin, and a metal terminal plate 80 is embedded in a central portion of this nozzle body 70. This metal terminal plate 80 is integrally provided in the nozzle body 70 by insert molding in formation of the nozzle body 70. FIG. 17 is a perspective view showing the metal terminal plate 80. Referring to FIG. 17, the metal terminal plate 80 is provided with a terminal portion 81 which projects in the form of a flat plate. The metal terminal plate 80 is further provided with heat transfer portions 82 and 83, which are embedded in the interior of the nozzle body 70 along its inner surface.

Referring again to FIG. 16, a PTC element 72 is held between the terminal portion 81 of the metal terminal plate 80, serving as one terminal, and a spring terminal 73 serving as another terminal, to form a heater 71 in the nozzle body 70. A cover 74 is mounted on this heater 71. According to this embodiment, the metal terminal plate 80 is made of aluminum.

A voltage is applied across the terminal portion 81 of the metal terminal plate 80 and the spring terminal 73 so that the PTC element 72 generates heat, which in turn is transferred to the overall nozzle body 70 through the heat transfer portions 82 and 83 of the metal terminal plate 80, to heat the nozzle surface 70*c*.

Figure 18:
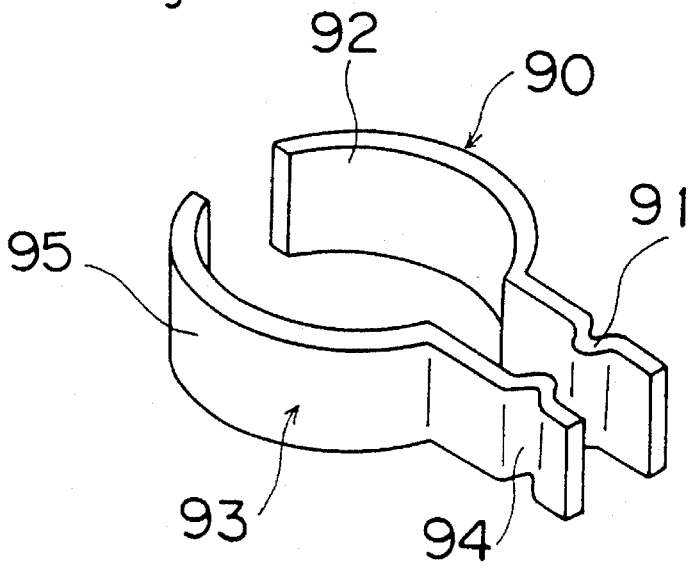
FIG. 18 is a perspective view showing metal bodies employed in another embodiment according to the fifth aspect of the present invention.
Figure 19:
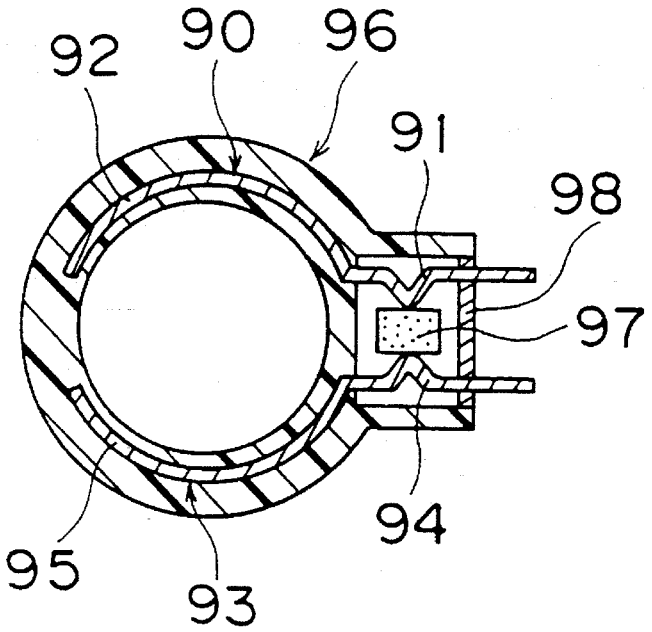
FIG. 19 is a cross-sectional view showing a nozzle body of the embodiment employing the metal bodies shown in FIG. 18.
Figure 20:
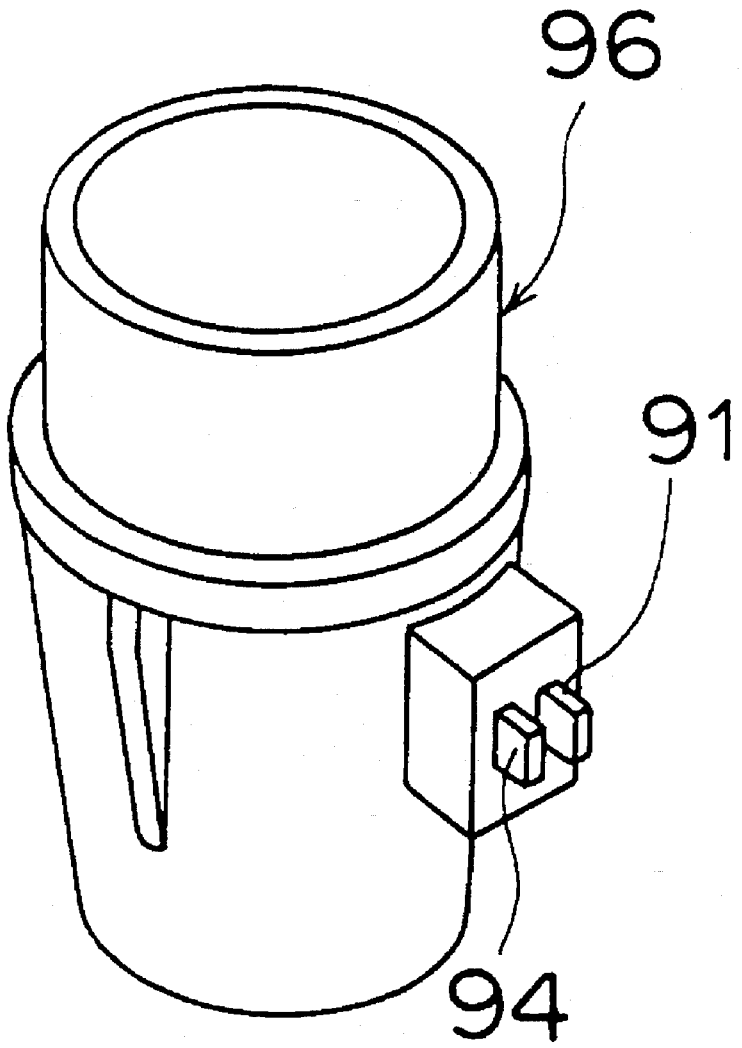
FIG. 20 is a perspective view showing the nozzle body of the embodiment employing the metal bodies shown in FIG. 18.

FIG. 18 is a perspective view showing metal terminal plates which are employed in another embodiment (Example 5-2) according to the fifth aspect of the present invention. According to this embodiment, two metal terminal plates 90 and 93 are combined with each other. FIG. 19 is a cross-sectional view showing the metal terminal plates 90 and 93 which are combined with each other and arranged in a nozzle body 96. Referring to FIG. 19, heat transfer portions 92 and 95 of the metal terminal plates 90 and 93 are embedded in the nozzle body 96 according to this embodiment. A PTC element 97 is held between terminal portions 91 and 94 of the metal terminal plates 90 and 93. A cover 98 is mounted on the as-formed heater portion. FIG. 20 is a perspective view showing the nozzle body 96 formed in the aforementioned manner.

Referring to FIG. 19, a voltage is applied across the terminal portions 91 and 94 of the metal terminal plates 90 and 93 so that the PTC element 97 generates heat, which in turn is transferred to the overall nozzle body 98 through the heat transfer portions 92 and 95 of the metal terminal plates 90 and 93, to homogeneously heat the interior of the nozzle body 96.

In Example 5-1 shown in FIG. 16, the PTC element 72 was prepared from that having a diameter of 6 mm, a Curie point of 80° C., and $R_{25}$ of 30 Ω, and the metal terminal plate 90 was prepared from an aluminum metal plate having a width of 8 mm and a thickness of 0.5 mm. A dc current of 12 V was fed across the terminal portion 81 of the metal terminal plate 80 and the spring terminal 73, to measure temperatures at a temperature measuring point 75, being closer to the heater 71, and an opposite temperature measuring point 76 on the nozzle surface 70*c* of the nozzle body 70.

For the purpose of comparison, the nozzle body according to Example 1—1, provided with no metal terminal plate, was similarly energized to measure temperatures on a heater side and an opposite side. Table 4 shows the results.

TABLE 4

| | Temperature on Heater Side | Temperature on Opposite side |
|---|---|---|
| Example 5-1 | 57.7 *C | 56.2° C. |
| Example 1-1 | 70.5 *C | 27.0° C. |

(Ambient Temperature: 25° C.)

It is clearly understood from Table 4 that the nozzle body according to Example 5-1 exhibited a smaller temperature difference between the heater side and the opposite side as compared with the nozzle body according to Example 1—1 provided with no metal terminal plate. Thus, it has been confirmed possible to improve temperature homogeneity by providing a metal terminal plate having heat transfer portions according to the fifth aspect of the present invention.

According to the present invention, as hereinabove described, it is possible to evaporate moisture of a liquid adhering to a nozzle inner surface for preventing bacterial multiplication or the like, while such heating can be homogeneously carried out along the overall nozzle body.

Figure 21:
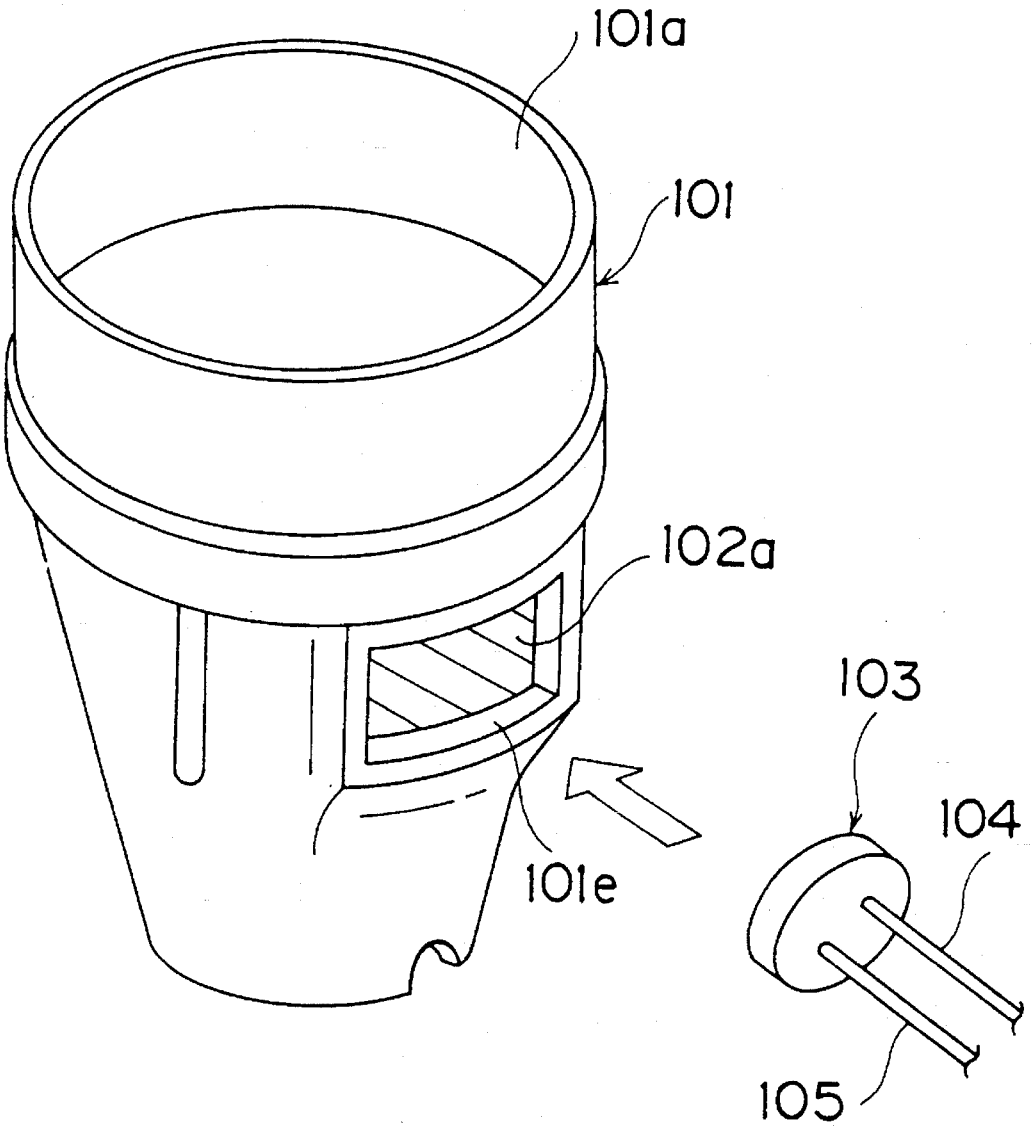
FIG. 21 is a perspective view showing a cup vendor delivery nozzle of an embodiment according to the sixth aspect of the present invention.

FIG. 21 is a perspective view for illustrating a cup vendor delivery nozzle of an embodiment according to the sixth aspect of the present invention. A nozzle body 101 is formed by a cylindrical member, which is entirely made of synthetic resin.

Figure 22:
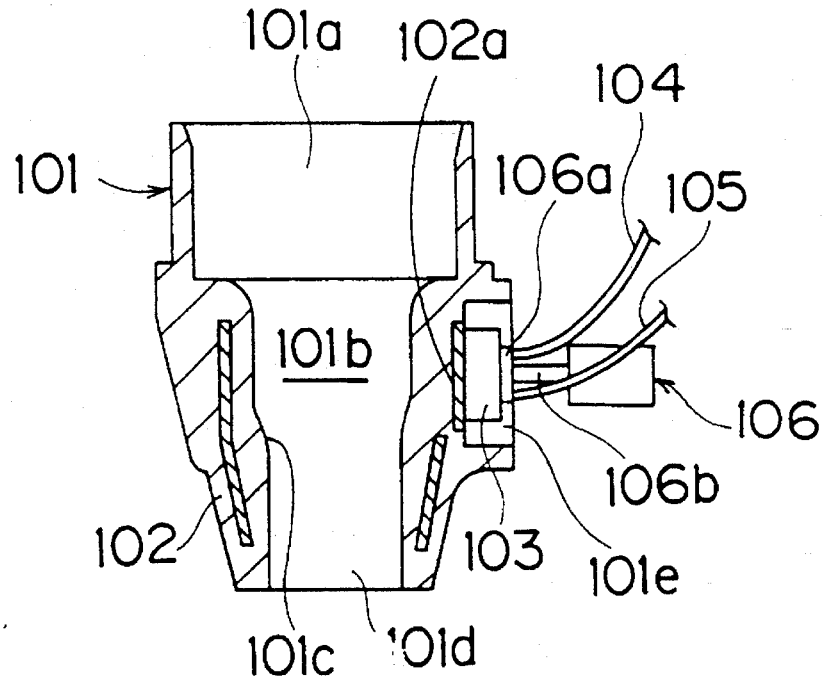
FIG. 22 is a longitudinal sectional view of the embodiment shown in FIG. 21.

As clearly understood from a side sectional view shown in FIG. 22, the nozzle body 101 has an entry 101*a* on its upper portion. A mixing portion 101*b* which is smaller in diameter than the entry 101*a* is provided under the entry 101*a*, while a mixed liquid delivery port 101*d* is provided on a lower end of the nozzle body 101.

According to this embodiment, a metal body 102 is exposed at a vertical central position of the nozzle body 101. A heater 103 described later is brought into pressure contact with an exposed surface 102*a* of the metal body 102.

Figure 24:
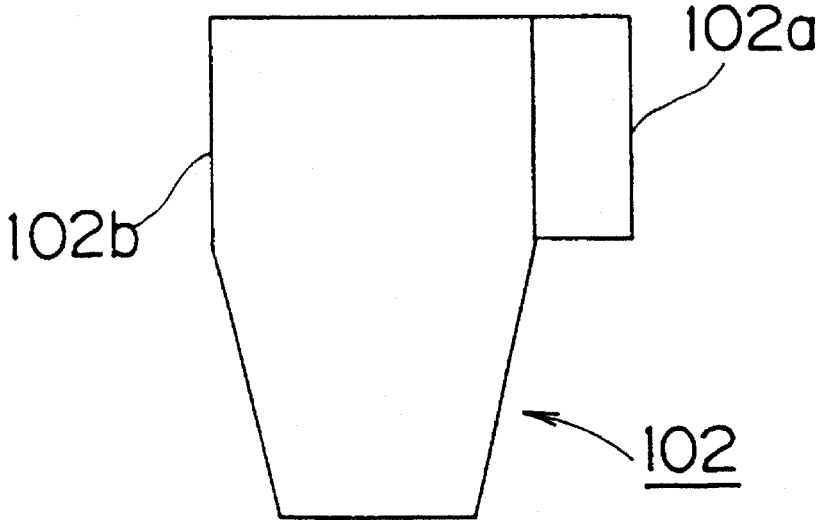
FIG. 24 is a side elevational view showing a metal body employed in the embodiment shown in FIG. 22.
Figure 25:
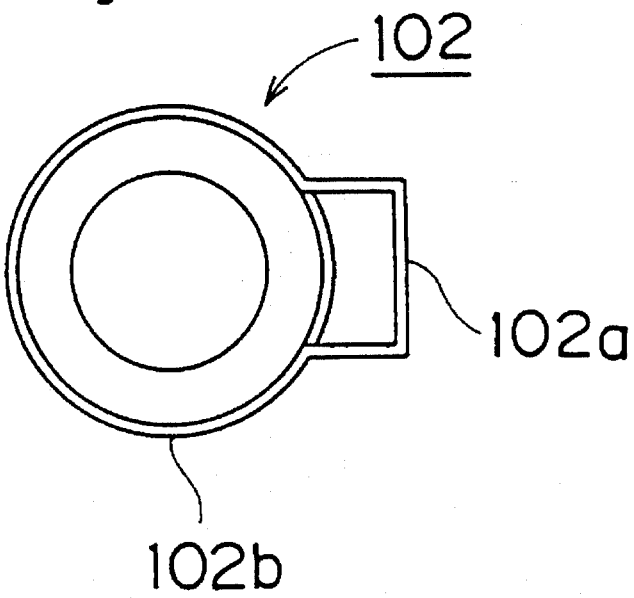
FIG. 25 is a plan view showing the metal body employed in the embodiment shown in FIG. 22.

As shown in FIGS. 24 and 25, the metal body 102 has a substantially cylindrical tubular portion 102*b* which is formed to be narrowed in diameter from its central position toward a lower end, and the aforementioned exposed surface 102*a* which is formed to outwardly project from an upper portion of the tubular portion 102*b*. The metal body 102 is previously arranged in a metal mold in molding of the nozzle body 101 of synthetic resin, to be embedded in the nozzle body 101 by the so-called insert molding.

A heater storage portion 101*e* is provided on the outer peripheral surface of the nozzle body 101 in a portion exposing the exposed surface 102*a* of the metal body 102. This heater storage portion 101*e* has a plane shape in the form of a rectangular cavity, so that the exposed surface 102*a* is exposed on its bottom surface.

The heater 103, which is formed by a PTC element according to this embodiment, may be prepared from another resistive element which generates heat by energization, in place of the PTC element. Referring again to FIG. 21, numerals 104 and 105 denote lead wires, which are electrically connected to the PTC element in order to feed power to the heater 103. The periphery of the PTC element is coated with protective resin, so that forward ends of the lead wires 104 and 105 are connected to the PTC element in such a resin coating.

Figure 23:
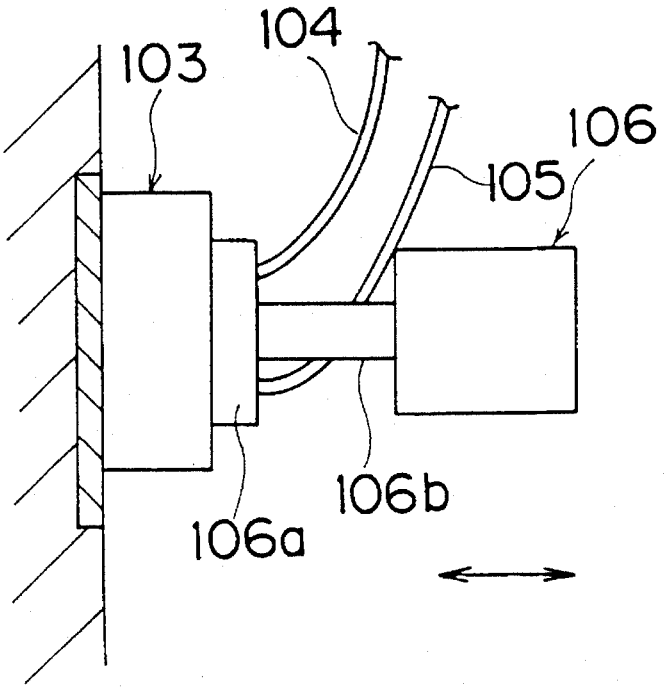
FIG. 23 is an enlarged view showing a portion around a heater shown in FIG. 22.

The feature of this embodiment resides in that the heater 103 is formed to be capable of coming into pressure contact with and separating from the exposed surface 102*a* of the metal body 102. As clearly understood from FIG. 22 and FIG. 23 showing a principal part appearing in FIG. 22 in an enlarged manner, a plate 106*a* is fixed to a surface of the heater 103 which is opposite to that brought into contact with the exposed surface 102*a*, and this plate 106*a* is coupled to a cylinder rod 106*b* of an air cylinder 106. The air cylinder 106 is so driven that the heater 103 can reciprocate along arrow shown in FIG. 23, thereby taking a state being in pressure contact with the exposed surface 102*a* and a state separating from the same.

According to this embodiment, the air cylinder 106 is employed as means for allowing the heater 103 to come into contact with and separate from the exposed surface 102*a* of the metal body 102. Alternatively, the heater 103 may be coupled to a forward end of a coil spring, to be brought into pressure contact with the exposed surface 102*a* by elastic force of the coil spring. As to separation of the heater 103 from the exposed surface 102*a*, force may be applied to compress the coil spring against its elastic force, so that the heater 103 separates from the exposed surface 102*a*.

In the cup vendor delivery nozzle according to this embodiment, the heater 103 is normally in pressure contact with the exposed surface 102*a* so that heat generated by this heater 103 is efficiently dispersed in the nozzle body 101 through the metal body 102. Therefore, a nozzle inner surface 101*c* of the nozzle body 101 is so efficiently heated that a liquid such as syrup adhering to the nozzle inner surface 101*c* is heated and dried to keep the nozzle inner surface 101*c* clean.

When the outer surface of the nozzle body 101 is stained with scattered droplets or the nozzle inner surface 101*c* of the nozzle body 101 is contaminated after a long use, the air cylinder 106 is driven to allow the heater 103 to separate from the exposed surface 102*a* of the metal body 102, so that only the nozzle body 101 can be detached for washing.

In such detachment of the nozzle body 101, the heater 103 completely separates from the nozzle body 101. Thus, the heater 103 is hardly damaged since no mechanical stress is applied to the same.

Figure 26:
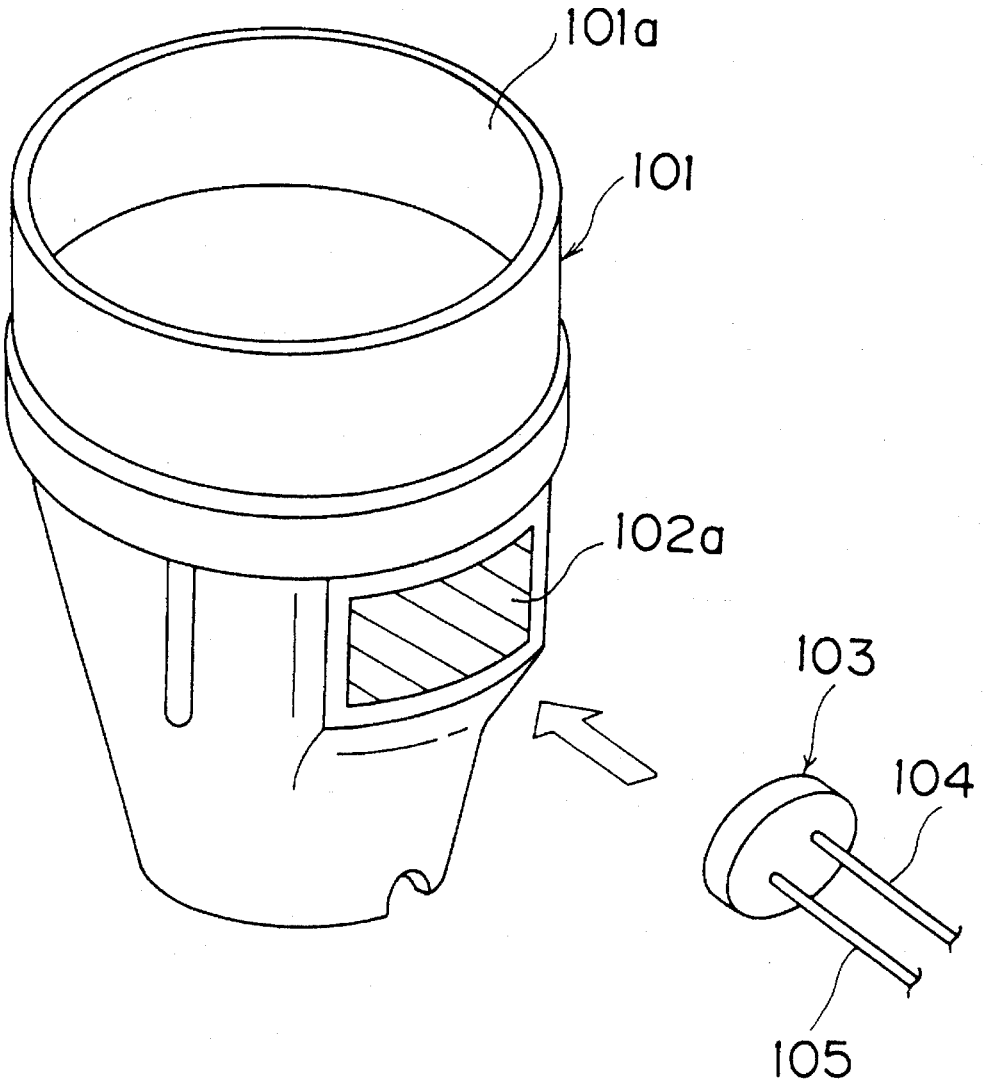
FIG. 26 is a perspective view showing a cup vendor delivery nozzle of another embodiment according to the sixth aspect of the present invention.

FIG. 26 is a perspective view for illustrating a cup vendor delivery nozzle of another embodiment according to the sixth aspect of the present invention. According to this embodiment, an exposed surface 102*a* of a metal body 102 is exposed to be flush with an outer side surface of a nozzle body 101. Namely, the nozzle body 101 is provided with no portion corresponding to the heater storage portion 101*e* provided in the embodiment shown in FIG. 21. In other points, this embodiment is formed in a similar manner to that shown in FIG. 21. Thus, the heater body 101 may be provided with no heater storage portion, and also in this case, a heater 103 is brought into pressure contact with the exposed surface 102*a* by the aforementioned heater pressing means, to be reliably fixed thereto.

Figure 27:
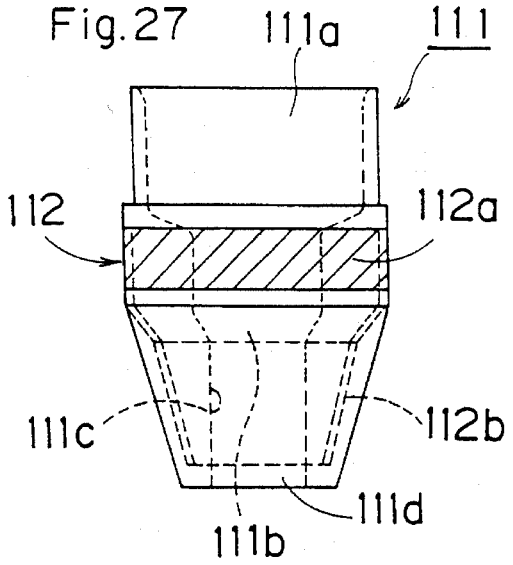
FIG. 27 is a side elevational view showing a nozzle body of an embodiment according to the seventh aspect of the present invention.

FIG. 27 is a side elevational view showing a nozzle body 111 of a cup vendor delivery nozzle of an embodiment according to the seventh aspect of the present invention. This nozzle body 111 is formed by a cylindrical member which isentirely made of synthetic resin, and is provided with an entry 111*a* on its upper portion. A mixing portion 111*b* which is smaller in diameter than the entry 111*a* is provided under the entry 111*a*, and a mixed liquid delivery port 111*d* is provided on a lower end of a nozzle inner surface 111*c*.

According to this embodiment, a metal body 112 is exposed in a portion having the maximum diameter, which is located at the vertical center of the nozzle body 111. The metal body 112 has a portion 112*a* which is exposed to circumferentially extend along the portion of the nozzle body 111 having the maximum diameter, and an embedded portion 112*b* which is inserted in the nozzle body 111 as shown by broken lines. The embedded portion 112*b* circumferentially extends along a lower portion of the nozzle body 111, although such extension is not clearly shown in FIG. 27. The metal body 112 is adapted to effectively guide heat which is generated by a heater as described later to the nozzle inner surface 111*c* of the nozzle body 111. The metal body 112, which is made of a metal material to have excellent thermal conductivity, is preferably prepared from an uncorrodable metal material such as stainless steel.

Figure 28:
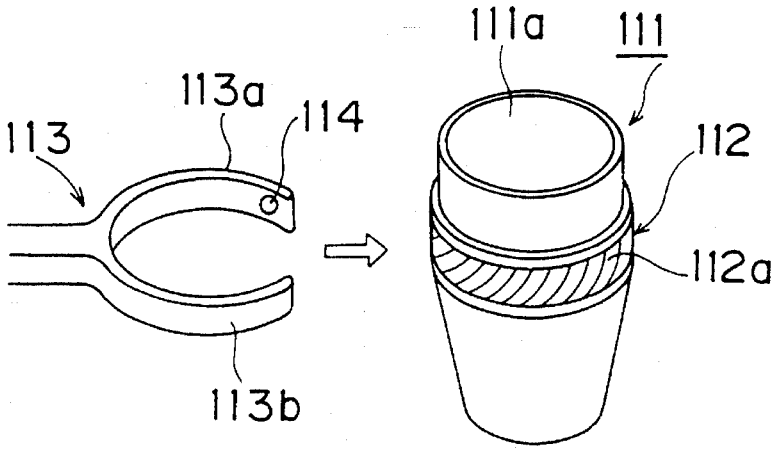
FIG. 28 is a perspective view showing a step of coupling a heater and the nozzle body with each other in the embodiment shown in FIG. 27.

FIG. 28 is a perspective view for illustrating a step of mounting a heater 113 on the aforementioned nozzle body 111 in the cup vendor delivery nozzle according to this embodiment. Referring to FIG. 28, the heater 113 is approached toward the nozzle body 111 from a side portion along arrow. The heater 113 has two branched forward end portions 113*a* and 113*b*. The branched forward end portions 113 and 113*b* are so formed that inner surfaces thereof are in conformity with an exposed portion 112*a* of the metal body 112. In other words, the inner surfaces of the branched forward end portions 113*a* and 113*b* are provided in the form of cylindrical curved surfaces in response to the exposed portion 112*a* of the metal body 112.

Heating portions 114 are provided on inner surface portions of the branched forward end portions 113*a* and 113*b* close to the forward ends thereof. According to this embodiment, the heating portions 114 are formed by fixing PTC elements. Alternatively, other elements generating heat by energization may be mounted to form the heating portions 114 in place of such PTC elements.

Although FIG. 28 shows no members, such as lead wires, for example, for feeding power to the PTC elements forming the heating portions 114, such lead wires etc. required for heating the PTC elements may be properly connected by a well-known or conventional method.

According to this embodiment, the branched forward end portions 113*a* and 113*b* of the heater 113 are made of a metal or synthetic resin. These branched forward end portions 113*a* and 113*b* are preferably made of synthetic resin or a metal having heat resistance to some extent, since the heating portions 114 generate heat to certain degrees of temperatures. When the branched forward end portions 113*a* and 113*b* are made of a metal, further, the heating portions 114 are preferably fixed to the inner surfaces of the branched forward end portions 113*a* and 113*b* with an insulating adhesive or the like, in order to ensure electrical isolation between the same and heat generating elements forming the heating portions 114.

The space between the branched forward end portions 113*a* and 113*b* is narrowed on the forward end sides. When the heater 113 is mounted on the nozzle body 111 as shown by arrow in FIG. 28, therefore, the space between the branched forward end portions 113*a* and 113*b* is so widened that the nozzle body 111 is inserted in a portion enclosed by the branched forward end portions 113*a* and 113*b* against force for approaching the forward ends of the branched forward end portions 113*a* and 113*b* with each other. After the forward ends of the branched forward end portions 113*a* and 113*b* pass through the maximum diameter portion of the nozzle body 111, the nozzle body 113 is elastically held between the branched forward end portions 113*a* and 113*b* by restoring force thereof.

Figure 29:
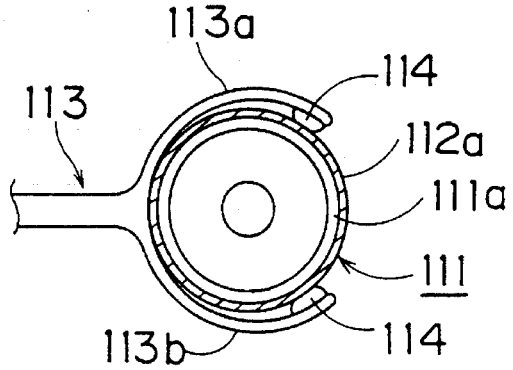
FIG. 29 is a partially fragmented plan view showing such a state that the nozzle body of the embodiment shown in FIG. 27 is elastically held between branched forward end portions of the heater so that the heater is fixed to the nozzle body.

FIG. 29 is a partially fragmented plan view showing the heater 113 and the nozzle body 111 which are fixed to each other. In such a fixed state of the heater 113 and the nozzle body 111, the exposed portion 112*a* of the metal body 112 of the nozzle body 111 is elastically held between the branched forward end portions 113*a* and 113*b*. When the nozzle body 111 is fixed to the cup vendor, therefore, the heater 113 is fixed to the nozzle body 111.

In order to wash the nozzle body 111, it is possible to easily detach the heater 113 from the nozzle body 111 by widening the space between the branched forward end portions 113*a* and 113*b*. Thus, only the nozzle body 11 can be removed from the cup vendor for washing.

As clearly understood from FIG. 29, the heating portions 114 mounted on the inner surfaces of the branched forward end portions 113*a* and 113*b* come into contact with the maximum diameter portion of the nozzle body 111, which is provided with the exposed portion 112*a* of the metal body 112. Therefore, heat generated by the heating portions 114 is directly transferred to the exposed portion 112*a* of the metal body 112, thereby efficiently heating the nozzle inner surface 111*c* of the nozzle body 111 through thermal conductivity of the metal body 112. Even if droplets containing sugar adhere to the nozzle inner surface 11*c*, therefore, such droplets are so dried that the nozzle inner surface 111*c* is regularly kept clean.

Although the heating portions 114 are provided on the inner surfaces of the branched forward end portions 113*a* and 113*b* in the aforementioned embodiment, at least one such heating portion may be provided for the heater as a whole. Therefore, such a heating portion may be provided only on one branched forward end portion. Alternatively, three or more heating portions may be provided for the heater as a whole.

According to the aforementioned embodiment, the exposed portion 112*a* of the metal body 112 is cylindrically formed on the maximum diameter portion of the nozzle body 111, to eliminate radial directivity in the nozzle body 111. Thus, the heating portions 114 can be reliably brought into contact with the metal body 112.

While the exposed portion 112*a* of the metal body 112 is formed to cylindrically extend along the maximum diameter portion of the nozzle body 111 according to this embodiment, this portion may be exposed only partially along the radial direction of the nozzle body 111. In this case, the heating portions 114 are preferably brought into contact with the exposed portion of the metal body 112. Thus, it is possible to reduce radiation from the exposed portion 112*a* to the exterior of the nozzle body 111 by reducing the area of the exposed portion 112*a* of the metal body 112, thereby further effectively heating the nozzle inner surface 111*c*.

According to the aforementioned embodiment, further, the heating portions 114 are provided on the respective branched forward portions 113*a* and 113*b* so that the exposed portion 112*a* of the metal body 112 is pressed by the heating portions 114 in two points, whereby constant pressing force can be attained in the contact portions between the heating portions 114 and the metal body 112, to reduce dispersion in resistance.

While the two branched forward end portions 113*a* and 113*b* hold the nozzle body 111 to detachably mount the heater 113 on the nozzle body 111 in the aforementioned embodiment, the heater 113 may be provided with three or more branched forward end portions.

Figure 30:
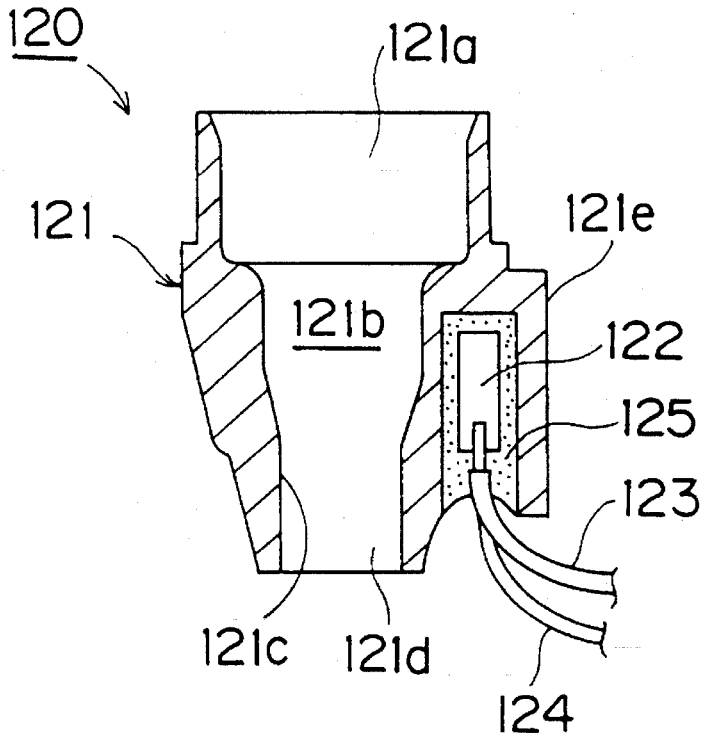
FIG. 30 is a longitudinal sectional view showing a nozzle body of a first embodiment according to the eighth aspect of the present invention.

FIG. 30 is a sectional view showing a cup vendor delivery nozzle 120 of a first embodiment according to the eighth aspect of the present invention. The cup vendor delivery nozzle 120 is provided with a nozzle body 121 having a substantially cylindrical shape as a whole. The nozzle body 121 is provided on its upper portion with an entry 121*a* to be inserted in a body delivery port. A mixing portion 121*b* having a slightly narrowed inner diameter is provided under the entry 121*a*, so that soda water or water which is supplied from the body delivery port comes into contact with a nozzle inner surface 121*c* in the mixing portion 121*b* and is mixed with syrup, to downwardly fall as a mixed liquid. A mixed liquid delivery port 121*d* is provided on a lower portion of the nozzle body 121.

According to this embodiment, a heater 122 is built into a heat storage portion 121*e* of the nozzle body 120, in order to heat the nozzle inner surface 121*c* of the nozzle body 121. The heater 122 is formed by a PTC thermistor element, and lead wires 123 and 124 are connected to this PTC thermistor element in order to allow heat generation.

The heater storage portion 121*e* outwardly projects from a portion of a side wall of the nozzle body 121, in a downwardly opening state. The heater 122 is inserted from below into the heater storage portion 121*e*, and its periphery is molded with synthetic resin 125, to be fixed to the heater storage portion 121*e*. As clearly understood from FIG. 30, the synthetic resin 125 is so charged as to cover not only the heater 122 of a PTC thermistor element but forward end portions of the lead wires 123 and 124 from which insulating coatings are removed. Even if the mixed liquid or the like is scattered toward the heater 122, therefore, no droplet adheres to the conductive portions since the conductive portions are covered with the synthetic resin 125 in the cup vendor delivery nozzle 120 according to this embodiment. Thus, the heater 122 is hard to deteriorate and the exposed portions of the lead wires 123 and 124 can be prevented from corrosion and contact failure, while it is possible to prevent an electric shock and an electric leak.

Further, the nozzle inner surface 121*c* is heated by the heat which is supplied from the heater 122, whereby moisture remaining in the nozzle inner surface 121*c* is so dried as to prevent bacterial multiplication or the like in the inner surface 121*c* of the nozzle body 121. Further, it is possible to suppress invasion of injurious insects such as ants or cockroaches.

Figure 31:
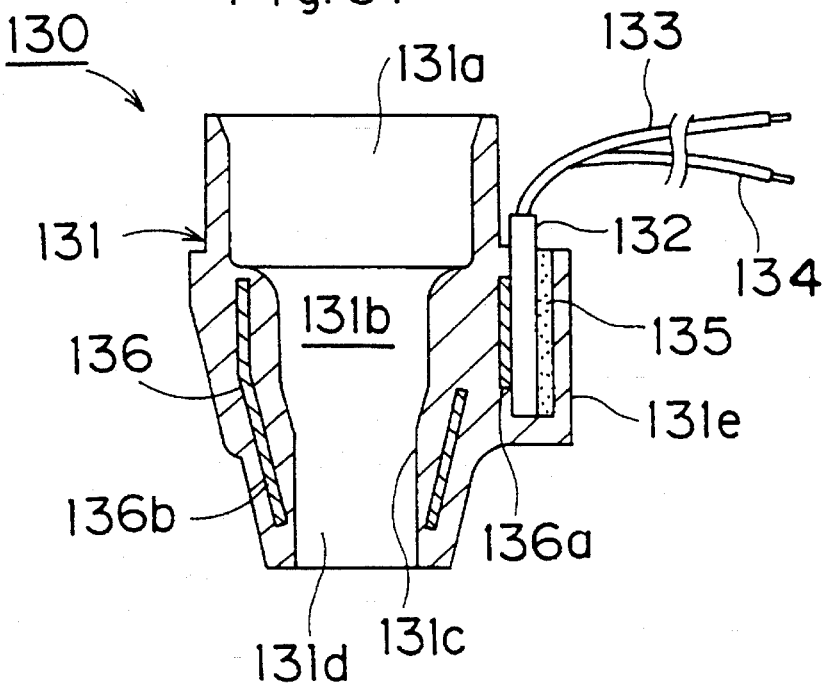
FIG. 31 is a longitudinal sectional view showing a delivery nozzle body of a second embodiment according to the eighth aspect of the present invention.

FIG. 31 is a sectional view showing a cup vendor delivery nozzle 130 of a second embodiment according to the eighth aspect of the present invention. The cup vendor delivery nozzle 130 has a substantially cylindrical nozzle body 131 which is made of synthetic resin. The nozzle body 131 is provided with an entry 131*a* on its upper portion, a mixing portion 131*b* having a slightly smaller diameter under the entry 131*a*, and a mixed liquid delivery port 131*d* on its lower portion, similarly to the first embodiment. A heater 132 is provided in order to heat a nozzle inner surface 131*c* of the nozzle body 131. According to this embodiment, the heater 132 has such a structure that a PTC element bonded with lead terminals 133 and 134 are coated with protective resin, not to expose conductive portions. Referring to FIG. 31, the heater 132 is shown in a state coated with the protective resin, and the PTC element is embedded in the protective resin.

The nozzle body 131 is provided on a portion of its outer peripheral surface with an outwardly projecting heater storage portion 131*e*, which has an upward opening for receiving the heater 132. The heater storage portion 131*e* is filled up with molding resin 135, so that the heater 132 is fixed in this heater storage portion 131*e*. The molding resin 135 is adapted to fix the heater 132, which is provided with the insulating coating of the aforementioned protective resin, to the nozzle body 131.

On the other hand, a metal body 136 is inserted in the nozzle body 131, to come into contact with the heater 132. The metal body 136, having a structure similar to that shown in FIGS. 24 and 25, is provided with a portion 136*a* which is arranged to come into contact with the heater 132, and a portion 136*b* which is embedded to circumferentially extend along a side wall of the nozzle body 131. Therefore, heat which is supplied from the heater 132 is efficiently dispersed along the overall nozzle inner surface 131*c* of the cylindrical nozzle body 151. Thus, it is possible to quickly dry a mixed liquid etc. adhering to the nozzle inner surface 131*c*.

According to the second embodiment, it is possible to dry the mixed liquid etc. adhering to the nozzle inner surface 131*c* similarly to the first embodiment, thereby maintaining the nozzle inner surface 131*c* in a sanitary state while suppressing invasion of ants or cockroaches. According to the second embodiment, further, the PTC element forming the heater 132 and the conductive portions of the lead wipes bonded to the PTC thermistor element are coated with the protective resin, whereby the delivery nozzle 130 can be washed with no attention required for adhesion of the washing solution to the conductive portions. In addition, an accident such as an electric leak or an electric shock is hard to occur.

While the heater 132 is prepared from a PTC element in the aforementioned embodiment, the PTC element may be replaced by another heat generating element which generates heat by energization. However, the PTC element is preferable since the same is excellent in safety due to its self temperature control function and can efficiently heat the cup vendor delivery nozzle 130 due to no possibility of excessive heating.

Figure 32:
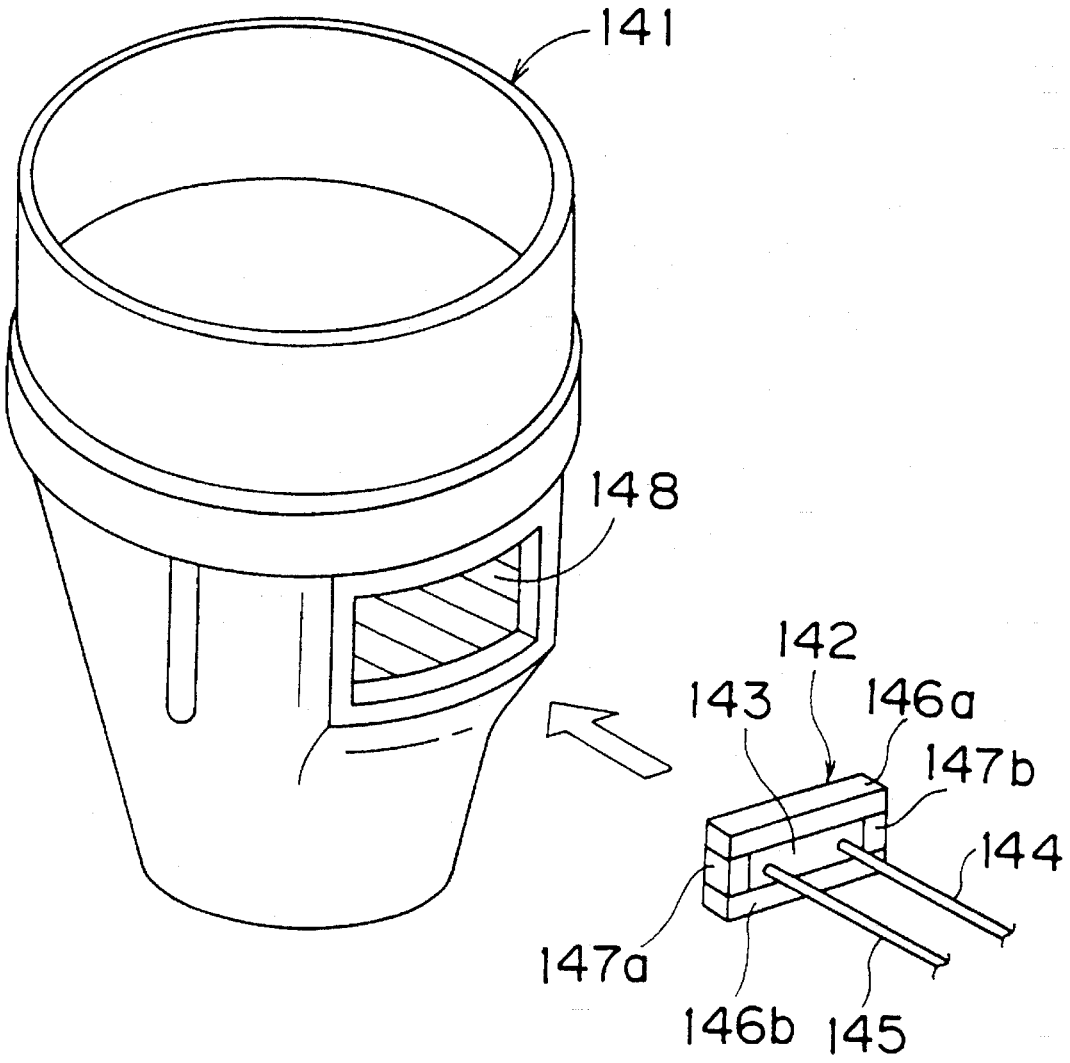
FIG. 32 is a perspective view showing a delivery nozzle body of a first embodiment according to the ninth aspect of the present invention.

FIG. 32 is a perspective view for illustrating a cup vendor delivery nozzle of a first embodiment according to the ninth embodiment of the present invention.

Figure 34:
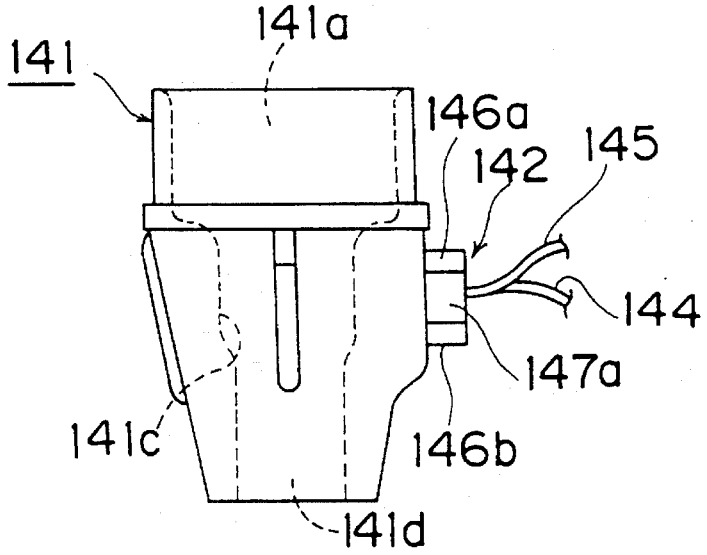
FIG. 34 is a side elevational view showing the delivery nozzle body of the embodiment shown in FIG. 32.
Figure 35:
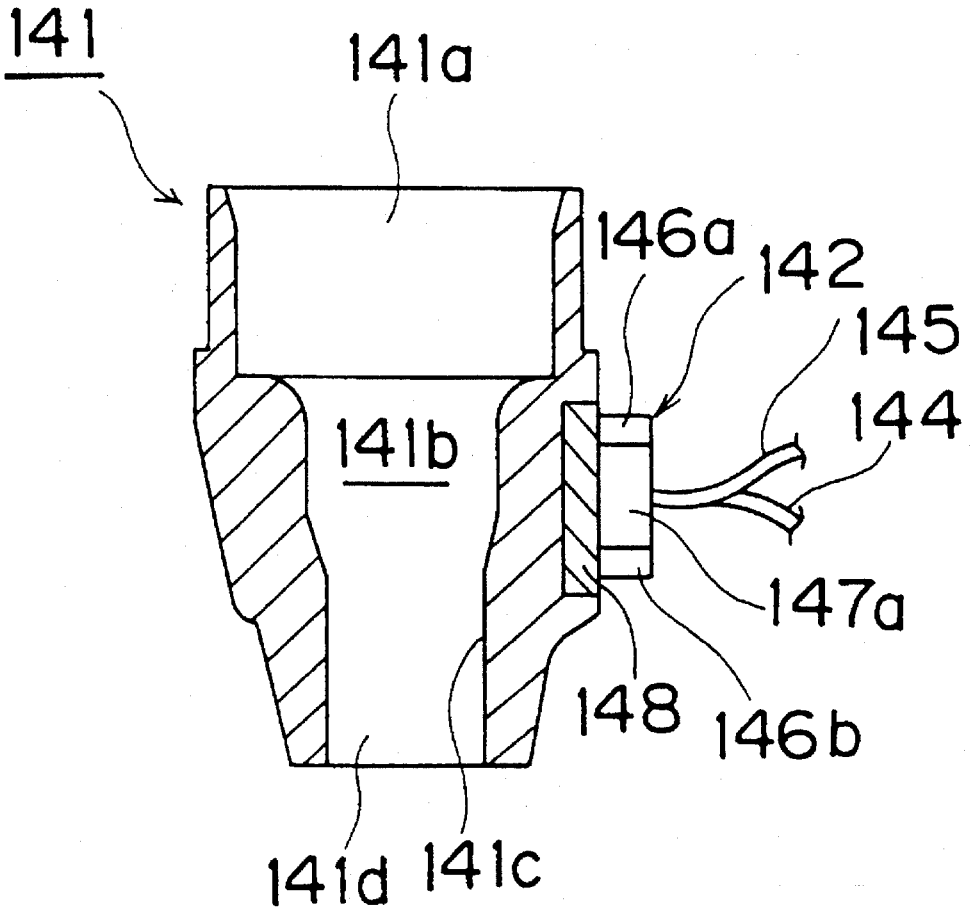
FIG. 35 is a longitudinal sectional view showing the delivery nozzle body of the embodiment shown in FIG. 32.

Referring to FIG. 32, the cup vendor delivery nozzle according to this embodiment has a nozzle body 141 and a heater 142. The nozzle body 141 is entirely formed by a substantially cylindrical member of synthetic resin. As illustrated in FIGS. 34 and 35 showing a mounted state of the heater 142 in a side elevational view and a side sectional view respectively, the nozzle body 141 is provided with an entry 141*a* on its upper portion. A mixing portion 141*b* having a slightly narrowed inner diameter is provided under the entry 141*a*. Soda water or water which is supplied from a body delivery port comes into contact with a nozzle inner surface 141*c*, and is mixed with syrup to downwardly fall as a mixed liquid. A mixed liquid delivery port 141*d* is provided on a lower end of the nozzle body 141.

According to this embodiment, the aforementioned heater 142 is magnetically coupled in order to heat the inner surface 141*c* of the nozzle body 141.

Figure 33:
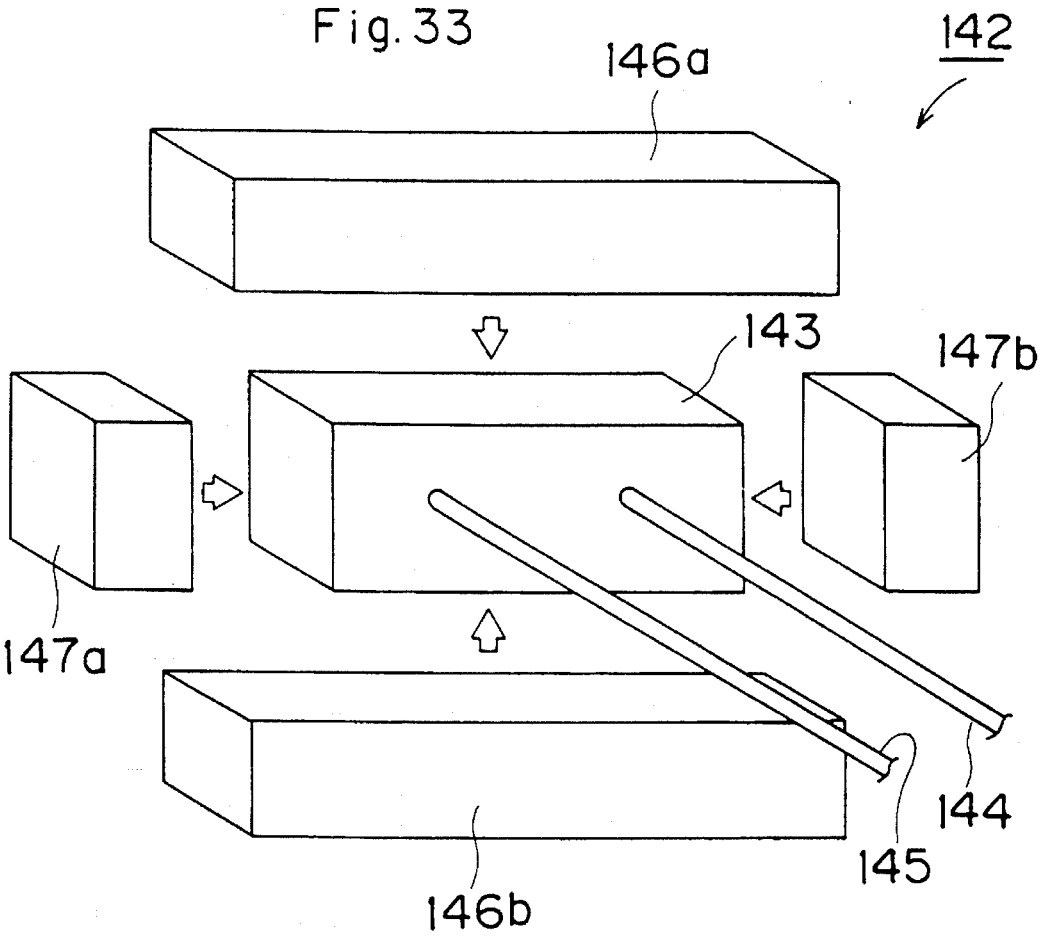
FIG. 33 is an exploded perspective view showing a heater employed in the embodiment shown in FIG. 32.

As understood from an exploded perspective view shown in FIG. 33, the heater 142 has a PTC element 143 serving as a heat generating element. This PTC element 143 may be replaced by another resistive element which generates heat by energization. The PTC element 143 is connected with lead wires 144 and 145, which are connected to an external power source to allow heat generation of the PTC element 143.

Metal plates 146*a* and 146*b* of a ferromagnetic material, such as iron, for example, is stuck onto upper and lower surfaces of the PTC element 143, while magnets 147*a* and 147*b* are stuck onto both side surfaces of the PTC element 143. Upper and lower surfaces of the magnets 147*a* and 147*b* are bonded to the metal plates 146*a* and 146*b* respectively. Thus, the PTC element 143, the metal plates 146*a* and 146*b* and the magnets 147*a* and 147*b* are integrated with each other to form the heater 142.

As clearly understood from FIGS. 32 and 35, on the other hand, a ferromagnetic material plate 148 of a material which is coupled with the magnets 147*a* and 147*b* by magnetic force, such as iron, nickel or stainless steel, for example, is embedded in the nozzle body 141 in a vertical intermediate position on the side surface, to expose its outer surface.

According to this first embodiment, therefore, the heater 142 is fixed to the nozzle body 141 by magnetic coupling between the magnets 147*a* and 147*b* and the ferromagnetic material plate 148 (see FIGS. 32 and 35). Thus, it is possible to heat the nozzle body 141 by heat generation of the heater 142, thereby drying the mixed liquid etc. adhering to the nozzle inner surface 141*c* of the nozzle body 141. Further, it is possible to prevent invasion of injurious insects such as ants or cockroaches by heating the interior of the nozzle body 141.

When it is necessary to wash the nozzle body 141, further, force may be applied to release the magnetic coupling between the magnets 147*a* and 147*b* and the ferromagnetic material plate 148, thereby detaching the nozzle body 141 from the heater 142. Thus, it is possible to easily remove only the nozzle body 141 for washing the same, and to again fix the same to the heater 142 by magnetic coupling.

Figure 36:
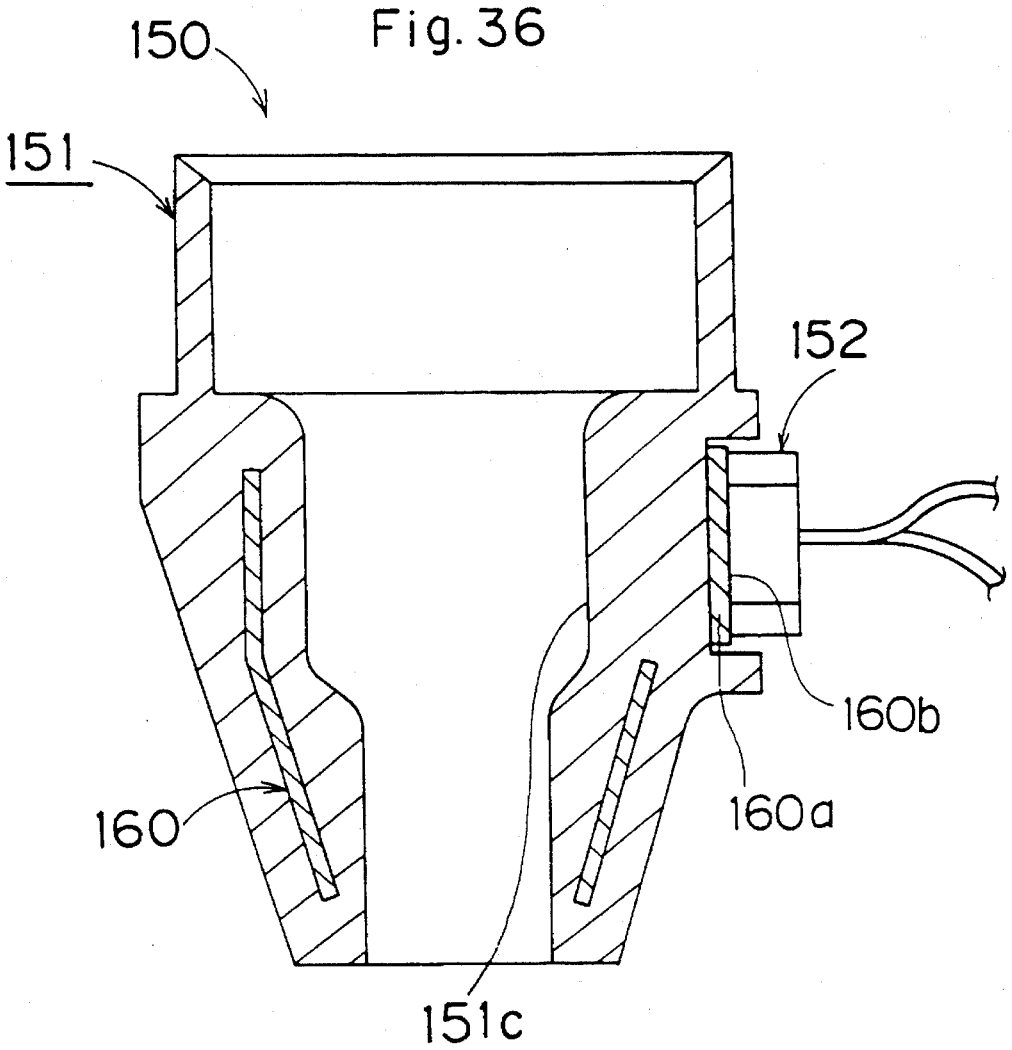
FIG. 36 is a longitudinal sectional view showing a delivery nozzle body of a second embodiment according to the ninth aspect of the present invention.

FIG. 36 is a side sectional view showing a cup vendor delivery nozzle 150 of a second embodiment according to the ninth aspect of the present invention. The cup vendor delivery nozzle 150 according to the second embodiment has a nozzle body 151 and a heater 152 which are formed similarly to those in the first embodiment. The second embodiment is different from the first embodiment in a point that a cylindrical metal body 160 of a ferromagnetic material, such as iron, for example, is embedded in a side wall of the nozzle body 151. The cylindrical metal body 160 has a structure similar to that of the metal body shown in FIGS. 24 and 25, with a cylindrical upper portion and a lower portion having a gradually narrowed diameter. Namely, the metal body 160 is shaped in conformity to the nozzle body 151 to be naturally embedded in the side wall of the nozzle body 151. A sideward protrusion 160*a* is provided on the cylindrical metal body 160, to outwardly project from a portion of its upper portion. The sideward protrusion 160*a* is so arranged that its outer surface 160*b* is exposed on the side surface of the nozzle body 151, as shown in FIG. 36. A heater 152 which is formed similarly to the heater 142 of the first embodiment is magnetically coupled to the outer surface 160*b*. According to the second embodiment, the outer surface 160*b* of the metal body 160 defines a ferromagnetic material member according to the present invention.

The metal body 160 can be previously inserted in a metal mold in molding of the nozzle body 151, to be easily embedded in the nozzle body 151 by the so-called insert molding.

According to the second embodiment, the metal body 160 is so embedded in the nozzle body 151 that heat which is supplied from the heater 152 is efficiently transferred to the nozzle body 151. Thus, it is possible to further quickly dry an inner surface 151*c* of the nozzle body 151 as compared with the first embodiment.

According to the second embodiment, the inserted metal body 150 is made of a ferromagnetic material so that a part thereof is employed as the ferromagnetic material member which is magnetically coupled with the heater 152. Alternatively, the ferromagnetic material may be formed independently of the metal body which is inserted in the nozzle body.

Figure 37:
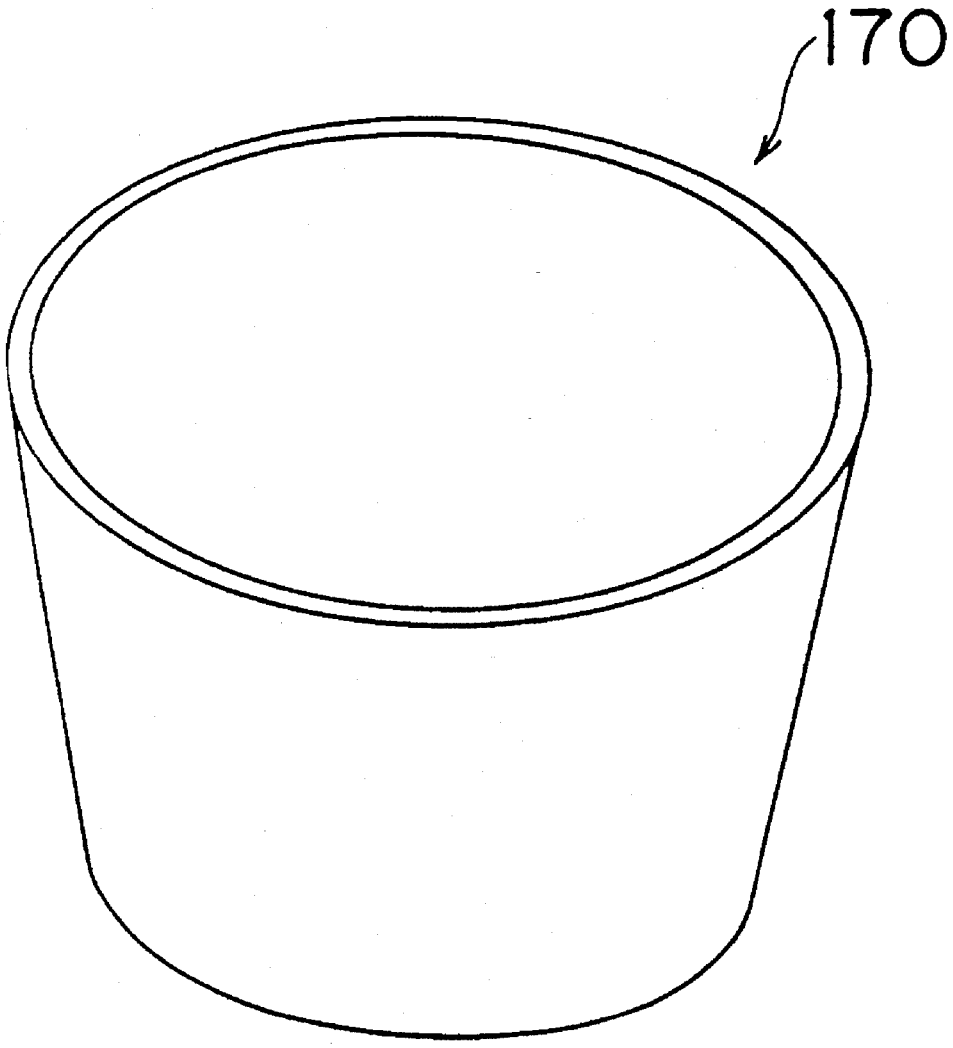
FIG. 37 is a perspective view showing another example of a metal body integrally provided in the nozzle body according to the present invention by insert molding.
Figure 38:
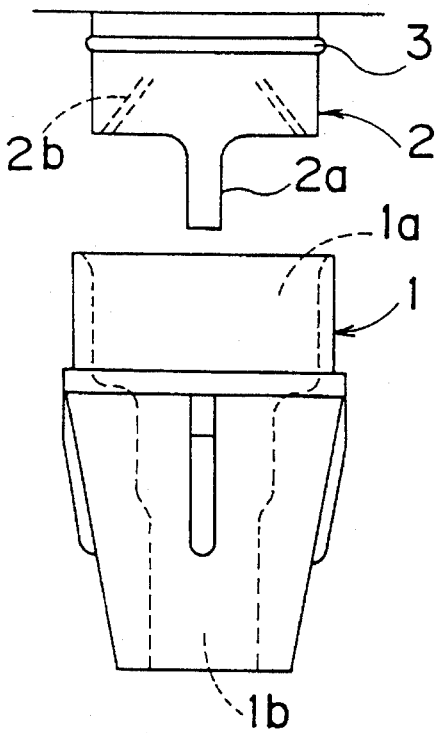
Fig. 38 PRIOR ART
FIG. 38 is a side elevational view showing a conventional cup vendor delivery nozzle.
Figure 39:
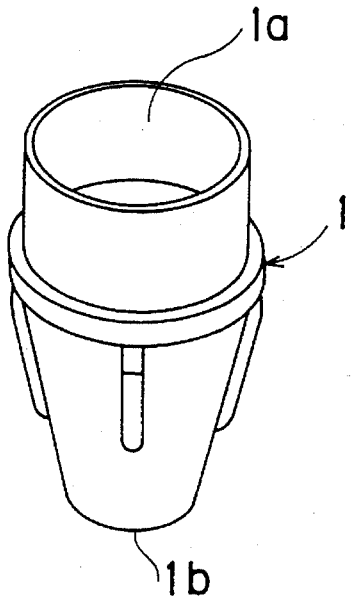
Fig. 39 PRIOR ART
FIG. 39 is a perspective view showing the conventional cup vendor delivery nozzle.

In the first embodiment, a substantially cylindrical metal body 170 shown in FIG. 37 may be embedded in the side wall of the nozzle body 141, for example. In this case, it is not necessarily required to prepare the metal body 170 from a ferromagnetic material, but the metal body 170 is preferably made of a material which is excellent in thermal conductivity such as Al, Cu or an alloy thereof, so that heat supplied from the heater 142 through the ferromagnetic material plate 148 is further efficiently dispersed in the nozzle body 141.

Alternatively, the metal body may be formed by a grid member which is formed by sticking a ferromagnetic material to a metal member having excellent thermal conductivity, so that it is possible to further improve heat dispersibility.

Although the magnets are integrally mounted on the heater 142 in the aforementioned embodiment, other magnets may be further provided on the nozzle body 141 to be magnetically coupled with the heater 142, or the magnets may alternatively be provided on the nozzle body 141 so that a ferromagnetic material member is integrally mounted on the heater 142 to be magnetically coupled with the magnets.

According to each of the first to ninth aspects of the present invention, the nozzle surface may be regularly continuously heated by the heater, or may be heated only in a time zone such as the nighttime when the delivery nozzle is rarely used.

Although the heater is formed by a PTC element in each of the aforementioned embodiments, the heater employed in the present invention is not restricted to such a PTC element. Further, although each of the embodiments has been described with reference to a delivery nozzle for mixing liquids in its interior, the present invention is not restricted to such a delivery nozzle but is also applicable to a delivery nozzle which is supplied with a previously mixed liquid.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A cup vendor delivery nozzle comprising:

a nozzle body having a substantially cylindrical shape;

a heater comprising a device for converting electrical energy into heat energy separate from the nozzle body for heating an inner surface of said nozzle body; and a metal hoop for transferring heat from said heater to an interior of said nozzle body, said heater heating a residue of liquid which is left in the nozzle body;

said nozzle body comprising an outer nozzle body and an inner nozzle body, said metal hoop being provided between the outer nozzle body and the inner nozzle body.

2. The cup vendor delivery nozzle in accordance with claim 1, further comprising a resin coating portion covering the periphery of said heater for protecting said heater against water.

3. The cup vendor delivery nozzle in accordance with claim 1, further comprising a magnet provided on one of said nozzle body and said heater, and a ferromagnetic material member provided on the other one of said nozzle body and said heater.

4. The cup vendor delivery nozzle in accordance with claim 1, wherein said heater is formed by a PTC thermistor element.

5. The cup vendor delivery nozzle in accordance with claim 1, wherein said metal hoop is integrally provided in the interior of said nozzle body by insert molding.

6. The cup vendor delivery nozzle in accordance with claim 1, wherein said metal hoop has a terminal portion serving as at least one terminal of said heater.

7. The cup vendor delivery nozzle in accordance with claim 1, further comprising a heater pressing means for allowing said heater to come into contact with and separate from said metal hoop.

8. The cup vendor delivery nozzle in accordance with claim 1, wherein said heater comprises at least two branched forward end portions for detachably holding said nozzle body therebetween, and at least one heating portion provided on an inner surface of either said branched forward end portion to come into contact with said metal hoop.

9. The cup vendor delivery nozzle in accordance with claim 1, wherein said metal hoop is disposed so that a lower edge thereof is positioned at a lower portion of said nozzle body and said heater is disposed opposed to an upper portion of said metal hoop.

10. The cup vendor delivery nozzle according to claim 1, wherein the inner and outer nozzle bodies are made of resin.

11. A cup vendor delivery nozzle comprising:

a nozzle body having a substantially cylindrical shape;

a heater comprising a device for converting electrical energy into heat energy separate from the nozzle body for heating an inner surface of said nozzle body; and a metal hoop for transferring heat from said heater to an interior of said nozzle body, said heater heating a residue of liquid which is left in the nozzle body;

said metal hoop being integrally provided in the interior of said nozzle body by insert molding.

12. The cup vendor delivery nozzle in accordance with claim 11, further comprising a resin coating portion covering the periphery of said heater for protecting said heater against water.

13. The cup vendor delivery nozzle in accordance with claim 1, further comprising a magnet provided on one of said nozzle body and said heater, and a ferromagnetic material member provided on the other one of said nozzle body and said heater.

14. The cup vendor delivery nozzle in accordance with claim 11, wherein said heater is formed by a PTC thermistor element.

15. The cup vendor delivery nozzle in accordance with claim 11, wherein said nozzle body comprises an outer nozzle body and an inner nozzle body, the metal hoop being provided between the outer nozzle body and the inner nozzle body.

16. The cup vendor delivery nozzle in accordance with claim 11, wherein said metal hoop has a terminal portion serving as at least one terminal of said heater.

17. The cup vendor delivery nozzle in accordance with claim 11, further comprising a heater pressing means for allowing said heater to come into contact with and separate from said metal hoop.

18. The cup vendor delivery nozzle in accordance with claim 11, wherein said heater comprises at least two branched forward end portions for detachably holding said nozzle body therebetween, and at least one heating portion provided on an inner surface of either said branched forward end portion to come into contact with said metal hoop.

19. The cup vendor delivery nozzle in accordance with claim 11, wherein said metal hoop is disposed so that a lower edge thereof is positioned at a lower portion of said nozzle body and said heater is disposed opposed to an upper portion of said metal hoop.

20. The cup vendor delivery nozzle according to claim 11, wherein the nozzle body is made of resin.

* * * * *